US008316968B2

(12) United States Patent
Ferrari et al.

(10) Patent No.: US 8,316,968 B2
(45) Date of Patent: Nov. 27, 2012

(54) ROLLING CONE DRILL BIT HAVING SHARP CUTTING ELEMENTS IN A ZONE OF INTEREST

(75) Inventors: Giampaolo Ferrari, Santo Stefano di Magra (IT); Gary Portwood, Florence (IT); Carl A. Deen, Choctaw, OK (US)

(73) Assignee: Smith International, Inc., Houston, TX (US)

( * ) Notice: Subject to any disclaimer, the term of this patent is extended or adjusted under 35 U.S.C. 154(b) by 274 days.

(21) Appl. No.: 12/771,346

(22) Filed: Apr. 30, 2010

(65) Prior Publication Data

US 2010/0276207 A1 Nov. 4, 2010

Related U.S. Application Data

(60) Provisional application No. 61/174,681, filed on May 1, 2009.

(51) Int. Cl.
*E21B 10/16* (2006.01)

(52) U.S. Cl. ..... 175/431; 175/341

(58) Field of Classification Search ..... 175/341, 175/425, 426, 430–432
See application file for complete search history.

(56) References Cited

U.S. PATENT DOCUMENTS

| | | | | |
|---|---|---|---|---|
| 5,341,890 | A | 8/1994 | Cawthorne | |
| 5,351,768 | A | 10/1994 | Scott et al. | |
| 5,407,022 | A | 4/1995 | Scott et al. | |
| 5,479,997 | A | 1/1996 | Scott et al. | |
| 5,592,995 | A | 1/1997 | Scott et al. | |
| 5,839,526 | A * | 11/1998 | Cisneros et al. | 175/431 |
| 5,868,213 | A | 2/1999 | Cisneros et al. | |
| 5,967,245 | A * | 10/1999 | Garcia et al. | 175/374 |
| 6,003,623 | A | 12/1999 | Miess | |
| 6,029,759 | A * | 2/2000 | Sue et al. | 175/374 |
| 6,345,673 | B1 | 2/2002 | Siracki | |
| 6,640,913 | B2 * | 11/2003 | Lockstedt et al. | 175/331 |
| 6,651,758 | B2 * | 11/2003 | Xiang et al. | 175/431 |
| 6,688,410 | B1 | 2/2004 | Singh | |
| 6,848,521 | B2 * | 2/2005 | Lockstedt et al. | 175/431 |
| 6,988,569 | B2 * | 1/2006 | Lockstedt et al. | 175/331 |
| 7,040,424 | B2 | 5/2006 | Yong et al. | |
| 7,059,430 | B2 | 6/2006 | Singh et al. | |
| 7,100,711 | B2 | 9/2006 | Witman et al. | |
| 7,124,842 | B2 * | 10/2006 | Lockstedt et al. | 175/374 |
| 7,367,413 | B2 * | 5/2008 | Lockstedt et al. | 175/331 |
| 7,407,012 | B2 | 8/2008 | Keshavan et al. | |
| 7,690,442 | B2 * | 4/2010 | Portwood et al. | 175/57 |
| 7,743,855 | B2 * | 6/2010 | Moss | 175/374 |
| 7,743,857 | B2 * | 6/2010 | Lockstedt et al. | 175/431 |
| 2001/0004026 | A1 * | 6/2001 | Lockstedt et al. | 175/431 |
| 2004/0045743 | A1 * | 3/2004 | Lockstedt et al. | 175/374 |
| 2005/0167162 | A1 * | 8/2005 | Lockstedt et al. | 175/431 |
| 2006/0027403 | A1 * | 2/2006 | Lockstedt et al. | 175/374 |

(Continued)

*Primary Examiner* — Jennifer H Gay

(57) ABSTRACT

A rolling cone drill bit comprises a bit body and a plurality of rolling cone cutters mounted on the bit body. Each cone cutter includes a plurality of gage cutting elements. Each gage cutting element has a cutting portion extending from a base portion to an extension height. Further, each gage cutting element contacts a gage curve at a gage curve contact point in a composite rotated profile view. Each gage cutting element has a cross-sectional area $A_1$ in a first offset reference plane parallel to a base reference plane and offset from the base reference plane by an offset distance $d_1$ equal to 10% of the extension height. The ratio of $A_1$ to a cross-sectional area $A_b$ of the base portion of each gage cutting element is less than 11%.

38 Claims, 23 Drawing Sheets

U.S. PATENT DOCUMENTS

2006/0260846 A1* 11/2006 Portwood et al. ..... 175/331
2006/0260847 A1* 11/2006 Lockstedt et al. ..... 175/331
2007/0084640 A1 4/2007 Singh
2008/0053710 A1* 3/2008 Moss ..... 175/426
2008/0308320 A1 12/2008 Kolachalam
2010/0276207 A1* 11/2010 Ferrari et al. ..... 175/341

* cited by examiner 10
11
12
13
19
22
24
44
34
28
26
49b
49a
2
42
5
16
40
60
44
50
6
61
20
62
62
31
62
48c
46
48b
7
48a 100
113
111
124
112
119
144
122
134
128
149b
126
149a
105
102
116
140
120
160
162
131
142
144
150
162
162
106
161
148c
146
148b
107
148a

ROLLING CONE DRILL BIT HAVING SHARP CUTTING ELEMENTS IN A ZONE OF INTEREST

CROSS-REFERENCE TO RELATED APPLICATIONS

This application claims benefit of U.S. provisional application Ser. No. 61/174,681 filed May 1, 2009, and entitled "Rolling Cone Drill Bit Having Sharp Cutting Elements in a Zone of Interest," which is hereby incorporated herein by reference in its entirety for all purposes.

STATEMENT REGARDING FEDERALLY SPONSORED RESEARCH OR DEVELOPMENT

Not Applicable.

BACKGROUND

1. Field of the Invention

The invention relates generally to earth-boring bits used to drill a borehole for the ultimate recovery of oil, gas or minerals. More particularly, the invention relates to rolling cone rock bits and to an improved cutting structure for such bits. Still more particularly, the invention relates to enhancements in gage row cutting element geometry and placement so as to reduce the likelihood of premature gage row cutting element wear.

2. Background of the Technology

An earth-boring drill bit is typically mounted on the lower end of a drill string and is rotated by rotating the drill string at the surface, actuation of downhole motors or turbines, or both. With weight applied to the drill string, the rotating drill bit engages the earthen formation and proceeds to form a borehole along a predetermined path toward a target zone. The borehole thus created will have a diameter generally equal to the diameter or "gage" of the drill bit.

An earth-boring bit in common use today includes one or more rotatable cutters that perform their cutting function due to the rolling movement of the cutters acting against the formation material. The cutters roll and slide upon the bottom of the borehole as the bit is rotated, the cutters thereby engaging and disintegrating the formation material in its path. The rotatable cutters may be described as generally conical in shape and are therefore sometimes referred to as rolling cones or rolling cone cutters. The borehole is formed as the action of the rotary cones remove chips of formation material that are carried upward and out of the borehole by drilling fluid which is pumped downwardly through the drill pipe and out of the bit.

The earth disintegrating action of the rolling cone cutters is enhanced by providing a plurality of cutting elements on the cutters. Cutting elements are generally of two types: inserts formed of a very hard material, such as tungsten carbide, that are press fit into undersized apertures in the cone surface, or teeth that are milled, cast or otherwise integrally formed from the material of the rolling cone. Bits having tungsten carbide inserts are typically referred to as "TCI" bits or "insert" bits, while those having teeth formed from the cone material are known as "steel tooth bits." In each instance, the cutting elements on the rotating cutters break up the formation to form the new borehole by a combination of gouging and scraping or chipping and crushing.

In oil and gas drilling, the cost of drilling a borehole is very high, and is proportional to the length of time it takes to drill to the desired depth and location. The time required to drill the well, in turn, is greatly affected by the number of times the drill bit must be changed before reaching the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer, and which are usable over a wider range of formation hardness.

The length of time that a drill bit may be employed before it must be changed depends upon its rate of penetration ("ROP"), as well as its durability. The form and positioning of the cutting elements upon the cone cutters greatly impact bit durability and ROP, and thus are critical to the success of a particular bit design.

To assist in maintaining the gage of a borehole, conventional rolling cone bits typically employ a heel row of hard metal inserts on the heel surface of the rolling cone cutters. The heel surface is a generally frustoconical surface and is configured and positioned so as to generally align with and ream the sidewall of the borehole as the bit rotates. The inserts in the heel surface contact the borehole wall with a sliding motion and thus generally may be described as scraping or reaming the borehole sidewall. The heel inserts function primarily to maintain a constant gage and secondarily to prevent the erosion and abrasion of the heel surface of the rolling cone. Excessive wear of the heel inserts leads to an undergage borehole, decreased ROP, increased loading on the other cutting elements on the bit, and may accelerate wear of the cutter bearings, and ultimately lead to bit failure.

Conventional bits also typically include one or more rows of gage cutting elements. Gage cutting elements are mounted adjacent to the heel surface but orientated and sized in such a manner so as to cut the corner of the borehole. In this orientation, the gage cutting elements cut both the borehole bottom and sidewall. The lower surface of the gage cutting elements engages the borehole bottom, while the radially outermost surface scrapes the sidewall of the borehole.

Conventional bits also include a number of additional rows of cutting elements that are located on the cones in rows disposed radially inward from the gage row. These cutting elements are sized and configured for cutting the bottom of the borehole and are typically described as inner row cutting elements and, as used herein, may be described as bottomhole cutting elements. Such cutters are intended to penetrate and remove formation material by gouging and fracturing formation material. In many applications, inner row cutting elements are relatively longer and sharper than those typically employed in the gage row or the heel row where the inserts ream the sidewall of the borehole via a scraping or shearing action.

The drilling of a borehole by a rolling cone bit causes considerable wear on the cutting elements, which detrimentally affects drilling life and effectiveness. The gage cutting elements are particularly susceptible to wear during drilling as the borehole corner is characterized by relatively high effective stresses that tend to make the borehole corner hard and difficult to drill.

Increasing ROP while simultaneously increasing the service life of the drill bit will decrease drilling time and allow valuable oil and gas to be recovered more economically. Accordingly, gage cutting element geometry, orientation, and placement on the rotatable cutters of a drill bit which enable increased ROP and longer bit life would be particularly desirable.

BRIEF SUMMARY

These and other needs in the art are addressed in one embodiment by a rolling cone drill bit for drilling a borehole in earthen formations. In an embodiment, the drill bit comprises a bit body having a bit axis. In addition, the drill bit comprises a plurality of rolling cone cutters mounted on the bit body, each cone cutter having a cone axis of rotation. Each cone cutter includes a plurality of gage cutting elements and a plurality of bottomhole cutting elements arranged in a first inner row radially adjacent the gage cutting elements relative to the bit axis. Further, each gage cutting element has a base portion with a central axis, a cutting portion extending from the base portion to an extension height measured perpendicularly from its respective cone cutter. Each gage cutting element contacts a gage curve defined by the drill bit at a gage curve contact point in a composite rotated profile view disposed in a layout plane, the layout plane containing one of the cone axes and being parallel to the bit axis. A base reference plane is perpendicular to the layout plane and tangent to the gage curve at the gage curve contact point in the composite rotated profile view. Each gage cutting element has a cross-sectional area $A_1$ in a first offset reference plane parallel to the base reference plane and offset from the base reference plane by an offset distance $d_1$ measured perpendicularly from the base reference plane, the offset distance $d_1$ being equal to 10% of the extension height. The base portion of each gage cutting element has a cross-sectional area $A_b$ in a plane perpendicular to the central axis of the base portion. The ratio of $A_1$ to $A_b$ is less than 11%.

These and other needs in the art are addressed in another embodiment by a rolling cone drill bit for drilling a borehole in earthen formations. In an embodiment, the drill bit comprises a bit body having a bit axis. In addition, the drill bit comprises a plurality of rolling cone cutters mounted on the bit body, each cone cutter having a cone axis of rotation. Each cone cutter includes a plurality of gage cutting elements and a plurality of bottomhole cutting elements arranged in a first inner row radially adjacent the gage cutting elements relative to the bit axis. Each gage cutting element has a base portion with a central axis, a cutting portion extending from the base portion to an extension height measured perpendicularly from its respective cone cutter. In addition, each gage cutting element contacts a gage curve defined by the drill bit at a gage curve contact point in a composite rotated profile view disposed in a layout plane, the layout plane containing one of the cone axes and being parallel to the bit axis. A base reference plane is perpendicular to the layout plane and tangent to the gage curve at the gage curve contact point in the composite rotated profile view. The cutting portion of each gage cutting element has a volume $V_1$ between the base reference plane and a first offset reference plane parallel to the base reference plane and offset from the base reference plane by an offset distance $d_1$ measured perpendicularly from the base reference, the offset distance $d_1$ being equal to 10% of the extension height. Further, the cutting portion of each gage cutting element has a volume $V_{cp}$, and the ratio of $V_1$ to $V_{cp}$ is less than or equal to 0.8%.

These and other needs in the art are addressed in another embodiment by a rolling cone drill bit for drilling a borehole in earthen formations. In an embodiment, the drill bit comprises a bit body having a bit axis. In addition, the drill bit comprises a plurality of rolling cone cutters mounted on the bit body, each cone cutter having a cone axis of rotation. Each cone cutter includes a plurality of gage cutting elements and a plurality of bottomhole cutting elements arranged in a first inner row radially adjacent the gage cutting elements relative to the bit axis. Each gage cutting element has a base portion with a central axis, a cutting portion extending from the base portion to an extension height measured perpendicularly from its respective cone cutter. In addition, each gage cutting element contacts a gage curve defined by the drill bit at a gage curve contact point in a composite rotated profile view disposed in a layout plane, the layout plane containing one of the cone axes and being parallel to the bit axis. A base reference plane is perpendicular to the layout plane and tangent to the gage curve at the gage curve contact point in the composite rotated profile view. An auxiliary plane perpendicular to the base reference plane and perpendicular to the layout plane passes through the gage curve contact point in the composite rotated profile view. The cutting portion of a first of the plurality of gage cutting elements has a cutting surface including a leading adjacent surface extending from the gage curve contact point and a trailing adjacent surface extending from the gage curve contact point. A tangent to the leading adjacent surface is oriented at a front leading angle $\alpha_{Layout}$ relative to the base reference plane in the composite rotated profile view, and a tangent to the leading adjacent surface is oriented at a front leading angle $\alpha_{Aux}$ relative to the base reference plane in the auxiliary plane. The front leading angle $\alpha_{Layout}$ or the front leading angle $\alpha_{Aux}$ is greater than 20°.

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1:
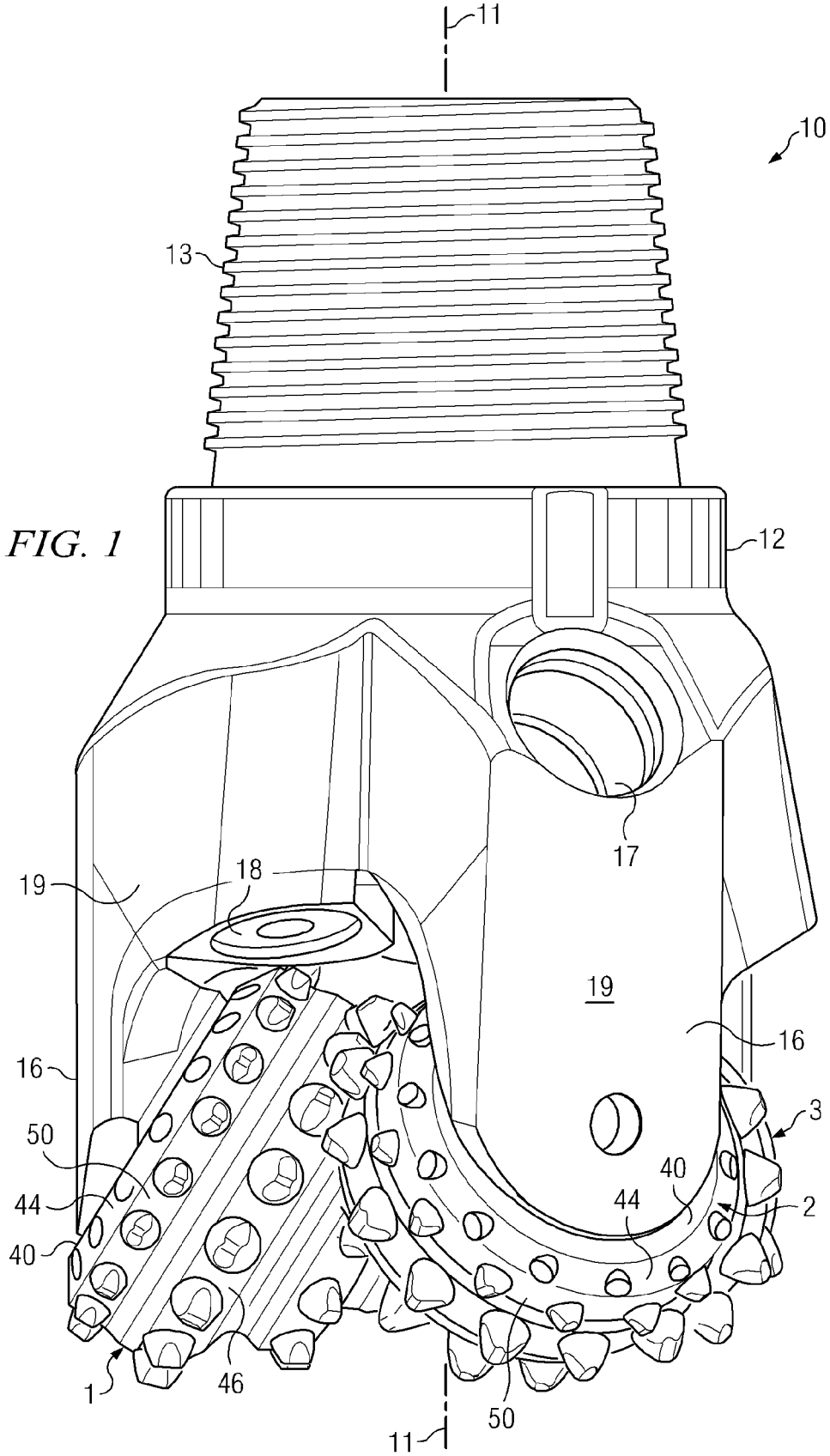
FIG. 1 is a perspective view of a conventional earth-boring bit

The following discussion is directed to various exemplary embodiments of the present invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Referring first to FIG. 1, a conventional earth-boring bit 10 is shown to include a central axis 11 and a bit body 12 having a threaded section 13 at its upper end that is adapted for securing the bit 10 to a drill string (not shown). Bit 10 has a predetermined gage diameter, defined by the outermost reaches of three rolling cone cutters 1, 2, 3 (cones 1 and 2 are visible in FIG. 1) which are rotatably mounted on bearing shafts that depend from the bit body 12. Bit body 12 is composed of three sections or legs 19 (two legs are visible in FIG. 1) that are welded together to form bit body 12. Bit 10 further includes a plurality of nozzles 18 that are provided for directing drilling fluid toward the bottom of the borehole and around cone cutters 1-3. Bit 10 includes lubricant reservoirs 17 that supply lubricant to the bearings that support each of the cone cutters 1-3. Bit legs 19 include a shirttail portion 16 that serves to protect the cone bearings and cone seals from damage caused by cuttings and debris entering between leg 19 and its respective cone cutter.

Figure 2:
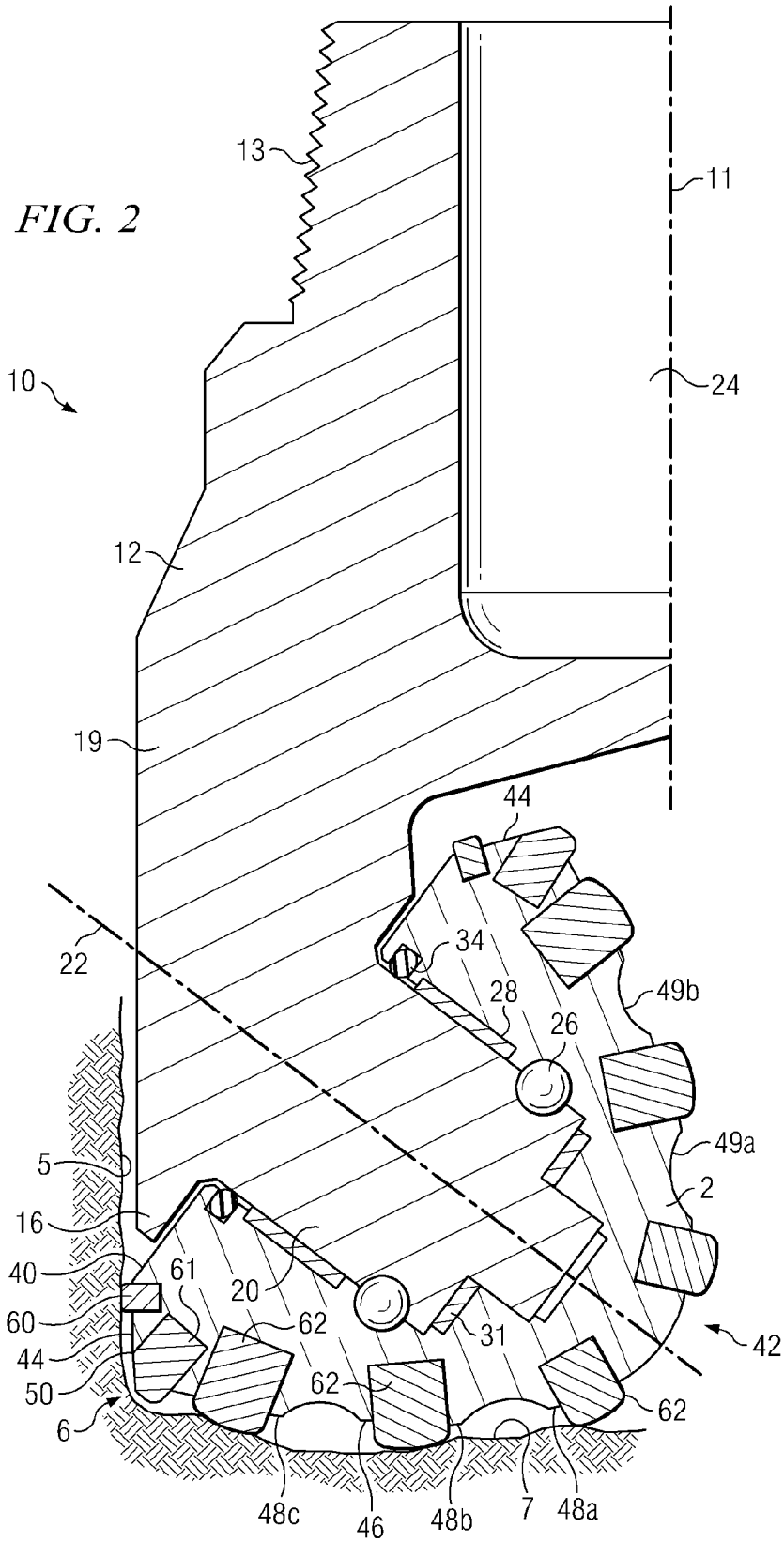
FIG. 2 is a partial section view taken through one leg and one rolling cone cutter of the bit shown in FIG. 1.

Referring now to both FIGS. 1 and 2, each cone cutter 1-3 is mounted on a pin or journal 20 extending from bit body 12, and is adapted to rotate about a cone axis of rotation 22 oriented generally downwardly and inwardly toward the center of the bit. Each cutter 1-3 is secured on pin 20 by locking balls 26, in a conventional manner. Radial thrusts and axial thrusts are absorbed by journal sleeve 28 and thrust washer 31. Lubricant may be supplied from reservoir 17 to the bearings by apparatus and passageways that are omitted from the figures for clarity. The lubricant is sealed in the bearing structure, and drilling fluid excluded therefrom, by means of an annular seal 34 which may take many forms. Drilling fluid is pumped from the surface through fluid passage 24 where it is circulated through an internal passageway (not shown) to nozzles 18 (FIG. 1).

Figure 3:
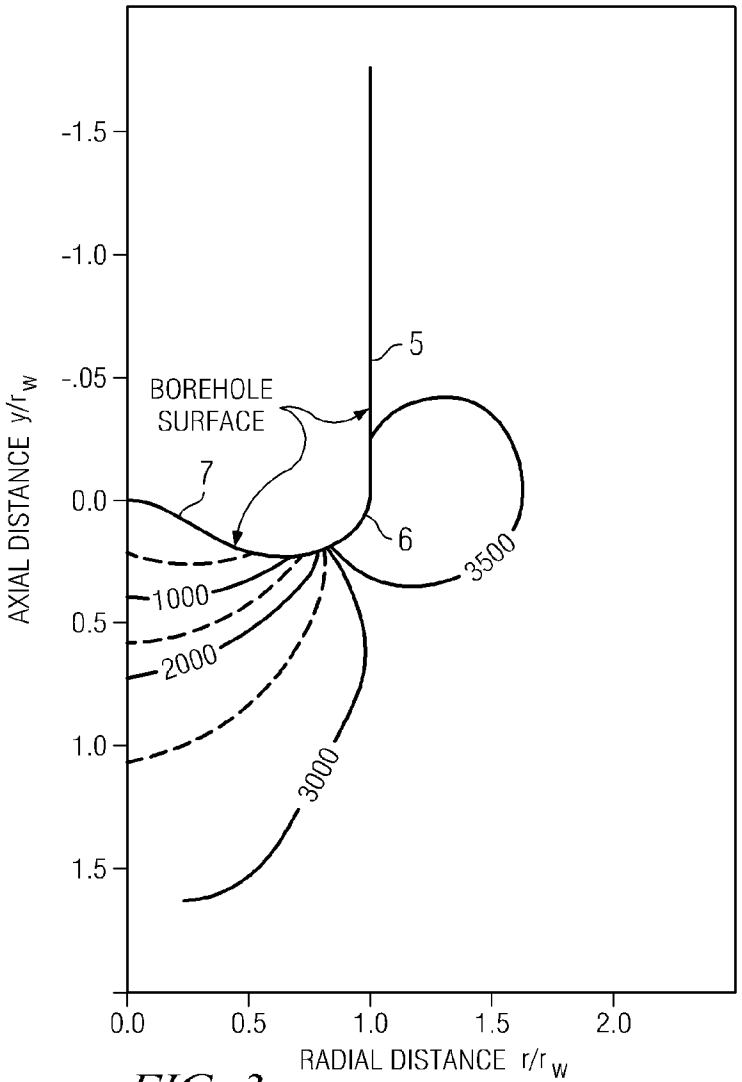
FIG. 3 is a plot illustrating the mean effective stress in the formation around a borehole.

As shown in FIG. 2, the borehole created by bit 10 includes sidewall 5, corner portion 6 and bottom 7. Referring momentarily to FIG. 3, the mean effective stress around a borehole is typically greatest at corner portion 6. Consequently, as compared to sidewall 5 and bottom 7 of the borehole, corner portion 6 is generally harder and more difficult to cut.

Referring again to FIGS. 1 and 2, each cutter 1-3 includes a generally planar backface 40 and nose 42 generally opposite backface 40. Adjacent to backface 40, cutters 1-3 further include a generally frustoconical surface 44 that is adapted to retain cutting elements that scrape or ream the sidewalls of the borehole as the cone cutters 1-3 rotate about the borehole bottom. Frustoconical surface 44 will be referred to herein as the "heel" surface of cone cutters 1-3, it being understood, however, that the same surface may be sometimes referred to by others in the art as the "gage" surface of a rolling cone cutter.

Extending between heel surface 44 and nose 42 is a generally conical cone surface 46 adapted for supporting cutting elements that gouge or crush the borehole bottom 7 as the cone cutters rotate about the borehole. Frustoconical heel surface 44 and conical surface 46 converge in a circumferential edge or shoulder 50. Conical surface 46 is divided into a plurality of generally frustoconical regions 48*a-c*, generally referred to as "lands", which are employed to support and secure the cutting elements as described in more detail below. Grooves 49*a, b* are formed in cone surface 46 between adjacent lands 48*a-c*.

In bit 10 illustrated in FIGS. 1 and 2, each cone cutter 1-3 includes a plurality of wear resistant inserts or cutting elements 60, 61, 62. These cutting elements each include a generally cylindrical base portion having a central axis, and a cutting portion that extends from the base portion and includes a cutting surface for engaging and cutting formation material. The cutting surface may be symmetric or asymmetric relative to the central axis. All or a portion of the base portion is secured by interference fit into a mating socket formed in the surface of the cone cutter. Thus, as used herein, the term "cutting surface" is used to refer to the surface of the cutting element that extends beyond the surface of the cone cutter. The extension height of the insert or cutting element is the distance from the cone surface to the outermost point of the cutting surface of the cutting element as measured perpendicular to the cone surface.

Referring specifically to FIG. 2, exemplary cone 2 includes heel cutting elements 60 extending from heel surface 44. Heel cutting elements 60 are designed to ream the borehole sidewall 5. Heel cutting elements 60 shown in FIG. 2 are generally flat-topped inserts. Moving axially with respect to cone axis 22 of cone 2 towards bit axis 11, adjacent to shoulder 50, cone 2 includes gage cutting elements 61. Gage cutting elements 61 are designed to cut corner portion 6 of the borehole. In other words, gage cutting elements 61 are positioned and oriented to cut a portion of sidewall 5 and a portion of borehole bottom 7. Thus, as used herein, the phrase "gage cutting element" refers to a cutting element that cuts the corner of the borehole (e.g., corner 6), and thus, engages the borehole sidewall (e.g., sidewall 5) and the borehole bottom (e.g., bottom 7). In conventional bit 10, gage cutting elements 61 include a conventional cutting surface having a generally slanted crest. Although cutting elements 61 are referred to herein as gage or gage row cutting elements, others in the art may describe such cutting elements as heel cutters or heel row cutters. Cone 2 also includes a plurality of bottomhole cutting elements 62, also referred to as inner row cutting elements, axially between gage cutting elements 61 and nose 42. Bottomhole cutting elements 62 are designed to cut the borehole bottom 7. Thus, as used herein, the terms "bottomhole" and "inner row" are used to described cutting elements or inserts that only cut the borehole bottom (e.g., bottom 7), and do not engage or cut any portion of the borehole sidewall (e.g., sidewall 5). Therefore, a cutting element that engages any portion of the borehole sidewall is not a bottomhole cutting element or an inner row cutting element. Bottomhole cutting elements 62 include conventional cutting surfaces having a generally rounded chisel shape. Although only cone cutter 2 is shown in FIG. 2, cones 1 and 3 are similarly configured.

Figure 4:
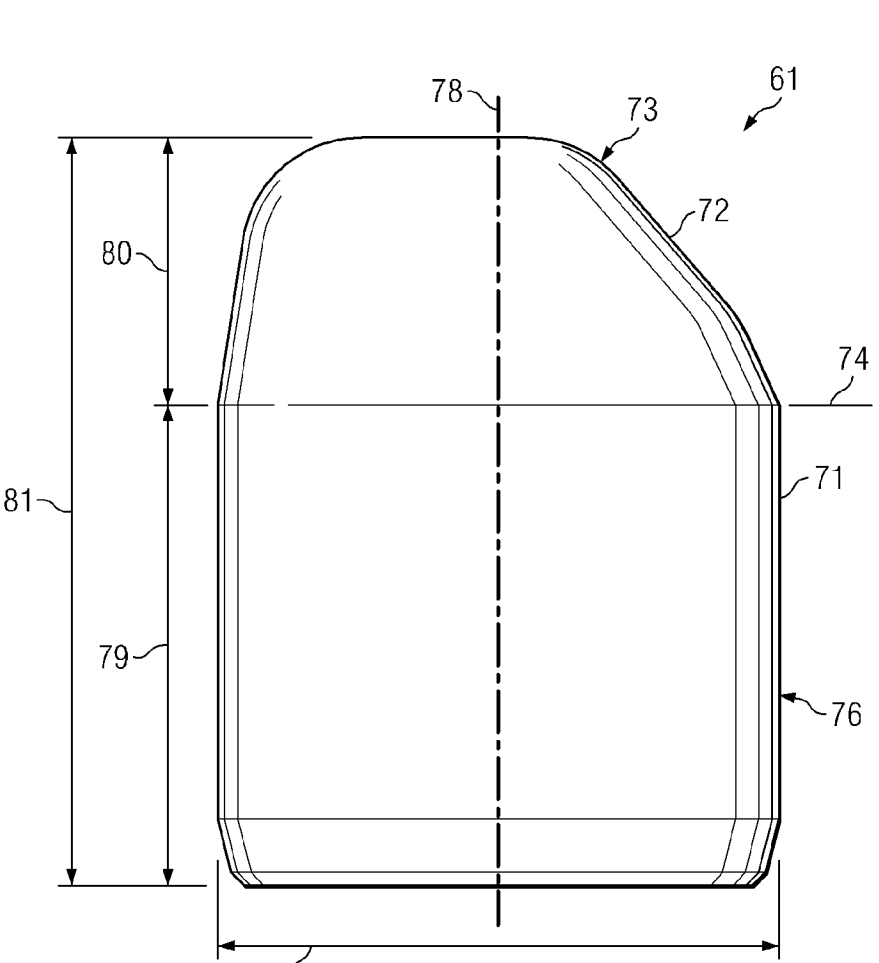
FIG. 4 is a side view of a conventional gage cutting element employed in the gage row of the bit shown in FIG. 1.

Referring now to FIG. 4, an enlarged side view of one of the conventional gage cutting elements 61 is shown. Gage cutter element or insert 61 includes a base portion 71 and a cutting portion 72 extending therefrom. Cutting portion 72 includes a cutting surface 73 extending from a reference plane of intersection 74 that divides base 71 and cutting portion 72. Base portion 71 is generally cylindrical, having a diameter 75, a central axis 78, and an outer cylindrical surface 76. Base portion 71 has a height 79, and cutting portion 72 extends from base portion 71 to an extension height 80. Collectively, base 71 and cutting portion 72 define the insert's overall height 81. As conventional in the art, base portion 71 is typically retained within a rolling cone cutter by interference fit, or by other means, such as brazing or welding, such that cutting portion 72 and cutting surface 73 extend beyond the cone steel. Once mounted, the extension height 80 of the cutter element 61 is generally the distance from the cone surface to the outermost point or portion of cutting surface 73 as measured perpendicular to the cone surface and generally parallel to the insert's axis 78. Although the geometry of the cutting portion of heel cutting elements 60 and bottomhole cutter elements 62 generally differ from that of gage cutting elements 61, cutting elements 60, 61 each include a base portion secured in the rolling cone cutter, a cutting portion including a cutting surface extending from the base portion to an extension height.

Figure 5:
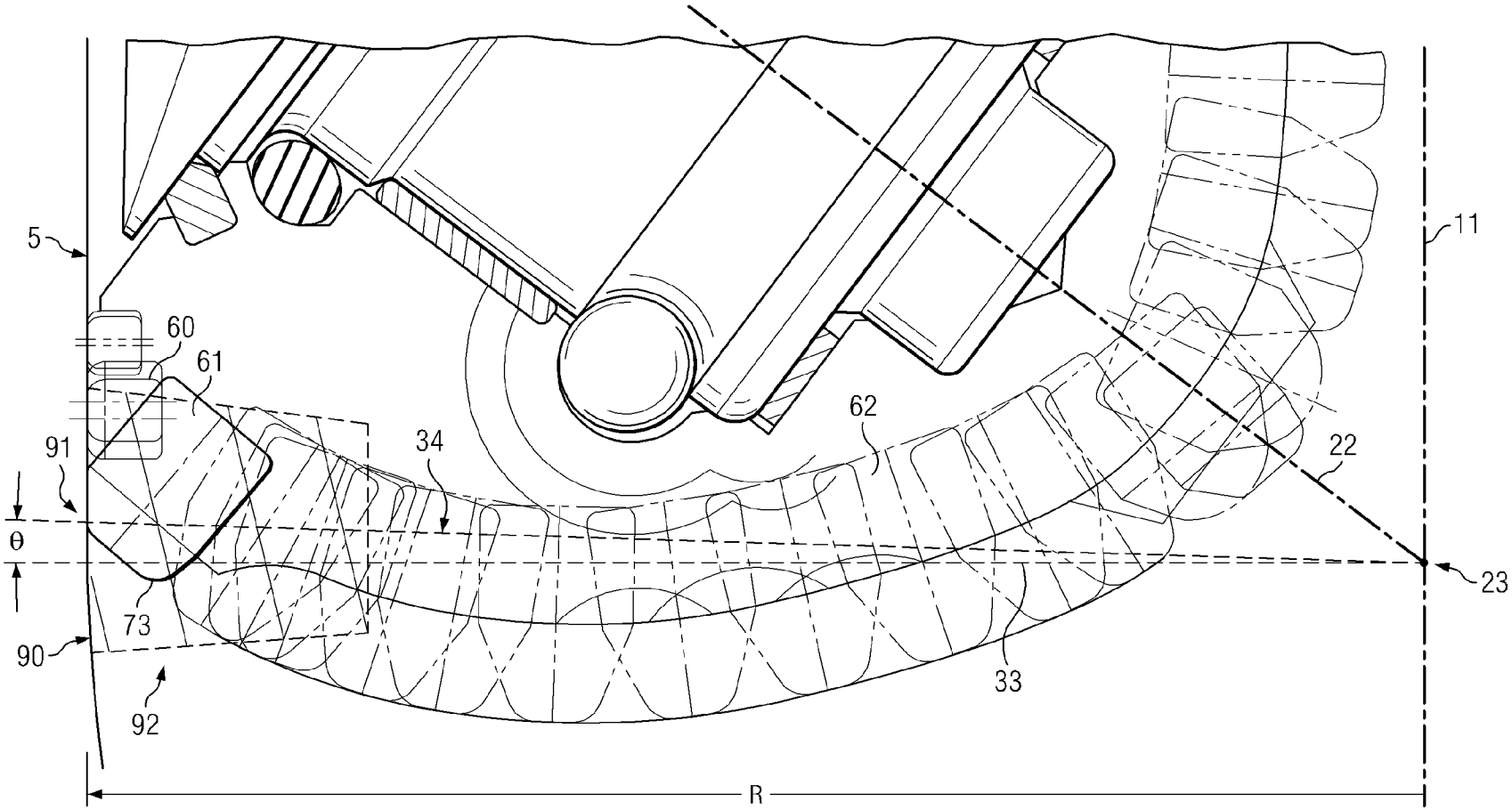
FIG. 5 is a schematic view showing, in composite rotated profile, the profiles of all of the cutting elements of the three cone cutters of the drill bit shown in FIG. 1.

Referring now to FIG. 5, the cutting surfaces, and hence cutting profiles, of each of the cutting elements 60, 61, 62 of all three cones 1-3 of conventional bit 10 are shown rotated into a single profile termed herein the "composite rotated profile view." The composite rotated profile view shows all of the cutting elements of all three cones rotated into a two dimensional plane, often referred to as a "layout plane," that contains one of the cone or journal axes and is oriented parallel to the bit axis. Thus, as used herein, the "layout plane" refers to a plane that contains a cone axis and is oriented parallel to the bit axis. In rotated profile view, the layout plane is represented by the plane of the paper. In the composite rotated profile view, the overlap of the profiles of cutting elements 60, 61, 62 on cones 1-3 are shown. Consequently, the composite rotated profile view illustrated in FIG. 5 shows the borehole coverage of the entire bit 10.

As understood by those skilled in the art of designing bits, a "gage curve" is commonly employed as a design tool to ensure that a bit made in accordance to a particular design will cut the specified borehole diameter. The gage curve is defined by a standard mathematical formulation which, based upon the parameters of bit diameter, journal angle, and journal offset, takes all the points that will cut the specified hole size, as located in three dimensional space, and projects these points into a two dimensional plane which contains the journal axis and is parallel to the bit axis (i.e., a layout plane). Calculation of the gage curve is known in the art, and is described, for example, in U.S. Pat. No. 5,833,020 issued to Portwood et al. and which is hereby incorporated herein by reference for all purposes. The use of the gage curve greatly simplifies the bit design process as it allows the gage cutting elements to be accurately located in two dimensional space, which is generally easier to visualize. The gage curve, however, should not be confused with the cutting path of any individual gage cutting element. A portion of a gage curve 90 is depicted in FIG. 5.

Referring still to FIG. 5, as is known in the art, the term "oversize angle" is a measure of the placement of a cutting surface of a cutting element mounted to a cone with respect to the true conical surface of the cone. As shown in FIG. 5, an oversize angle reference line 33 extends perpendicularly from bit axis 11 and passes through the intersection 23 of bit axis 11 and cone axis 22 in composite rotated profile view. Thus, as used herein, the phrase "oversize angle reference line" refers to the line that extends perpendicularly from the bit axis and passes through the intersection of the bit axis and the cone axis in composite rotated profile view. In addition, a gage curve contact point 91 represents the axially lowermost point (relative to bit axis 11) along gage curve 90 at which any cutting element contacts gage curve 90 in composite rotated profile view. Thus, as used herein, the phrase "gage curve contact point" refers to the axially lowermost point (relative to the bit axis) along a gage curve at which any cutting element contacts the gage curve in composite rotated profile view. Further, an oversize angle line 34 extends from intersection 23 of bit axis 11 and cone axis 22 to gage curve contact point 91 in composite rotated profile view. Thus, as used herein the phrase "oversize angle line" refers to the line extending from the intersection of the bit axis and the cone axis to the gage curve contact point in composite rotated profile view. The oversize angle θ is the angle measured from the oversize angle reference line 33 to the oversize angle line 34 in composite rotated profile view. Thus, as used herein the phrase "oversize angle" refers to the angle measured between the oversize angle reference line and the oversize angle line in composite rotated profile view. Typically, an oversize angle θ measured below the oversize angle reference line is considered a positive oversize angle θ, and an oversize angle θ measured above the oversize angle reference line is considered a negative oversize angle θ.

Referring still to FIG. 5, a zone of interest 92 is defined by an oversize angle θ between −15° and +15° (i.e., an oversize angle θ of 15° above and below the oversize angle reference line) and extends radially from 75% of the bit radius R and gage curve 90 in composite rotated profile view. Thus, as used herein, the phrase "zone of interest" refers to the region, in composite rotated profile view, axially (relative to bit axis 11) bounded by an oversize angle between −15° and +15° and radially extending from 75% of the bit radius and to the gage curve. Zone of interest 92 identifies those cutting elements (in composite rotated profile view) with cutting surfaces that engage the formation at or proximal the borehole corner (e.g., corner 6), and thus, engage the relatively high effective stress regions of the borehole. As shown in FIG. 5, cutting surface 73 of each gage cutting element 61 is within zone of interest 92.

Figure 6:
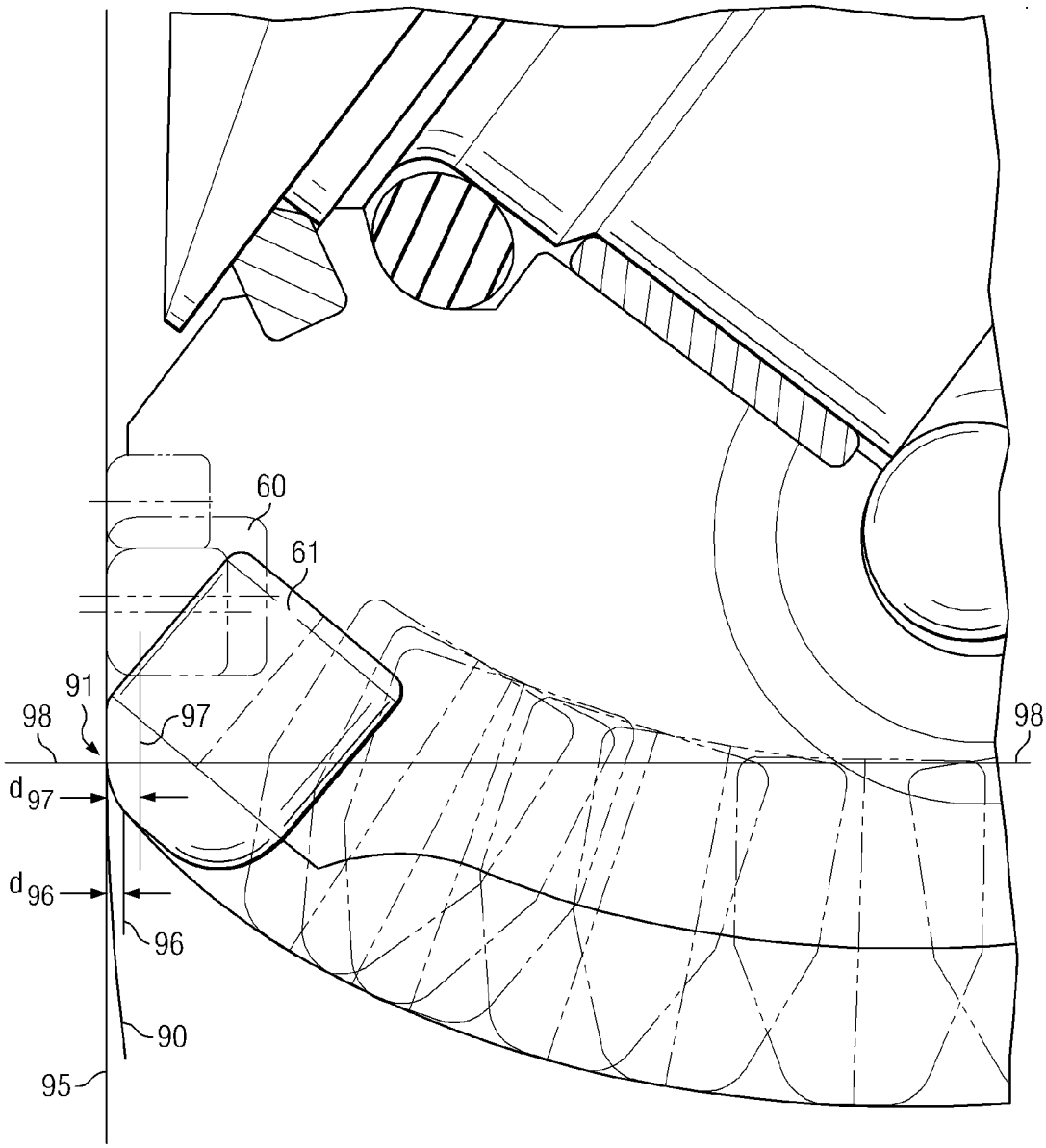
FIG. 6 is an enlarged view of the composite rotated profile view of FIG. 5.

Referring now to FIG. 6, a base reference plane 95 is tangent to gage curve 90 at gage curve contact point 91 in the layout plane and is perpendicular to the layout plane in composite rotated profile view. In other words, base reference plane 95 is perpendicular to the surface of the paper in FIG. 6 and is tangent to gage curve 90 at gage curve contact point 91 in the layout plane. Thus, as used herein, the phrase "base reference plane" refers to a plane that is tangent to the gage curve at the gage curve contact point in the layout plane and is perpendicular to the layout plane in composite rotated profile view. First and second offset reference planes 96, 97 are parallel to base reference plane 95, but offset or spaced from base reference plane 95 by offset distances $d_{96}$, $d_{97}$, respectively, measured perpendicularly from base reference plane 95 in composite rotated profile view. Thus, as used herein the phrase "offset reference plane" refers to any plane that is parallel to a base reference plane and is offset or spaced apart from the base reference plane, and the phrase "offset distance" refers to the distance measured perpendicularly from the base reference plane to a particular offset reference plane.

Figure 7:
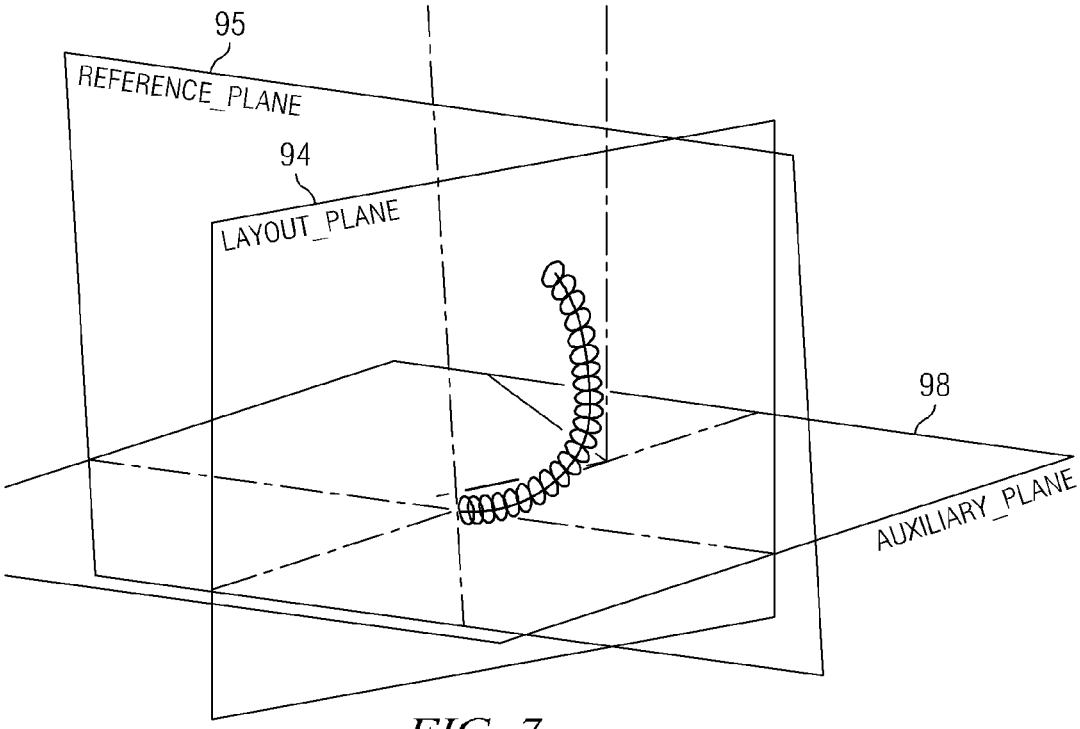
FIG. 7 is a three-dimensional view illustrating the orthogonal relationship between the layout plane, the base reference plane, and the auxiliary plane.

Referring still to FIG. 6, an auxiliary plane 98 is perpendicular to base reference plane 95, perpendicular to the layout plane containing the composite rotated profile view, and passes through gage curve contact point 91 in composite rotated profile view. Thus, as used herein, the phrase "auxiliary plane" refers to a plane that is perpendicular to the base reference plane, perpendicular to the layout plane containing the composite rotated profile view, and passes through the gage curve contact point in composite rotated profile view. Consequently, the layout plane containing the composite rotated profile view, the base reference plane (e.g., base reference plane 95), and the auxiliary plane (e.g., auxiliary plane 98) are orthogonal. FIG. 7 illustrates the layout plane identified by reference numeral 94, the base reference plane 95, and the auxiliary plane 98 in three-dimensions.

Figure 8:
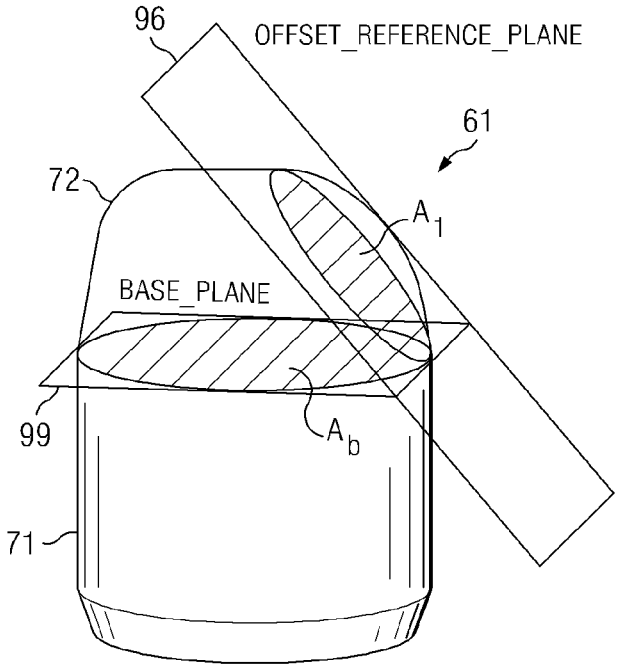
FIG. 8 is a perspective view of the gage cutting element of FIG. 4 illustrating the cross-sectional area of the cutting portion at an offset reference plane and the cross-sectional area of the base portion.

Referring now to FIGS. 6 and 8, the "sharpness," and hence cutting effectiveness of a particular gage cutting element (e.g., conventional gage cutting element 61) may be quantified by a "cutting tip cross-sectional area ratio" equal to the ratio of (a) the cross-sectional area of the cutting portion of the gage cutting element at an offset reference plane extending through the cutting portion to (b) the cross-sectional area of the base portion of the gage cutting element at a plane perpendicular to the central axis and extending through the base portion. For example, gage cutting element 61 has a cross-sectional area $A_1$ (FIG. 8) at first offset reference plane 96 disposed at offset distance $d_{96}$ in cutting portion 72 (FIG. 6), and a cross sectional area $A_b$ at a base plane 99 that is perpendicular to base axis 78 in base portion 71. The cutting tip cross-sectional area ratio of gage cutting element 61 at offset distance $d_{96}$ is $A_1/A_b$. It should be appreciated that since base portion 71 is cylindrical, the cross-sectional area of base portion 71 at any plane perpendicular to axis 78 is the same.

It should be appreciated that the offset distance of an offset reference plane may be expressed in terms of a percentage of the cutting element extension height. For example, offset distance $d_{96}$ of offset reference plane 96 may be expressed in terms of a percentage of extension height 80 (e.g., offset distance $d_{96}$ is 10% of extension height 80, offset distance $d_{97}$ is 15% of extension height 80, etc.). For most conventional gage cutting elements (e.g., gage cutting element 61), at an offset reference plane disposed at an offset distance (relative to the base reference plane) equal to 10% of the insert extension height, the cutting tip cross-sectional area ratio is greater than about 12%, and at an offset reference plane disposed at an offset distance (relative to the base reference plane) equal to 15% of the insert extension height, the cutting tip cross-sectional area ratio is greater than about 19.5%.

In general, for purposes of calculating the cutting tip cross-sectional area ratio, the offset reference plane at which the cross-sectional area of the cutting portion is taken (e.g., first offset reference plane 96) may be disposed at any suitable offset distance (e.g., offset distance $d_{96}$). However, for purposes of comparing the cutting tip cross-sectional area ratios of different cutting elements (e.g., two different gage cutting elements), and hence the sharpness of the different cutting elements, the cutting tip cross-sectional area ratios of the cutting elements being compared should be calculated at offset distances calculated at the same percentage of the gage cutting elements respective extension heights. For example, in comparing the sharpness of a first gage cutting element and a second gage cutting element, if the cutting tip cross-sectional area ratio of the first gage cutting element is calculated at an offset reference plane disposed at an offset distance equal to 10% of the extension height of the first gage cutting element, the cutting tip cross-sectional area ratio of the second gage cutting element should also be calculated at an offset reference plane disposed at an offset distance equal to 10% of the extension height of the second gage cutting element. It should be appreciated that the gage cutting elements may have different extension heights, and thus, 10% of the extension height of the first gage cutting element may be different from 10% of the extension height of the second gage cutting element. Consequently, the offset distance to an offset reference plane at 10% of the extension height of the first gage cutting element may be different than the offset distance to an offset reference plane at 10% of the extension height of the second gage cutting element.

Figure 9:
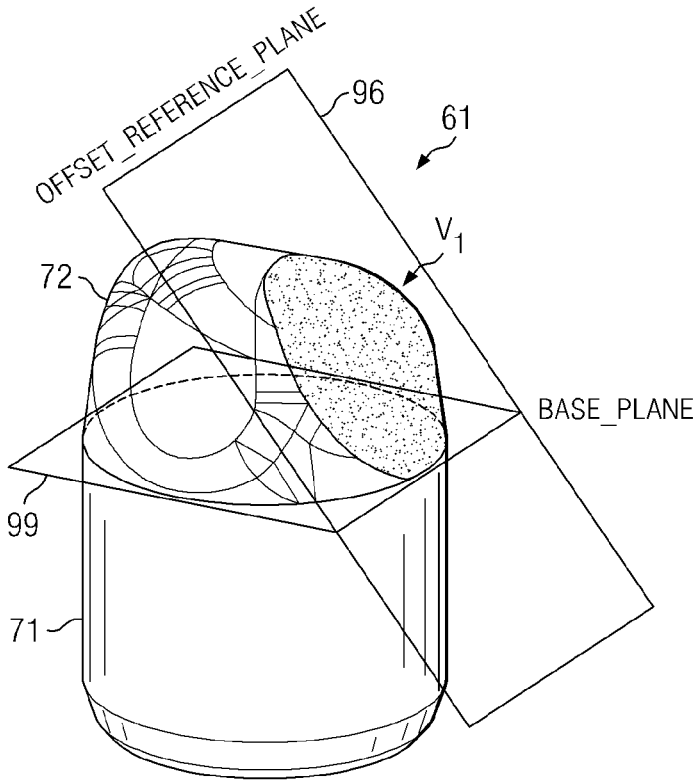
FIG. 9 is a perspective view of the gage cutting element of FIG. 4 illustrating the tip volume between an offset reference plane and the base reference plane.
Figure 10:
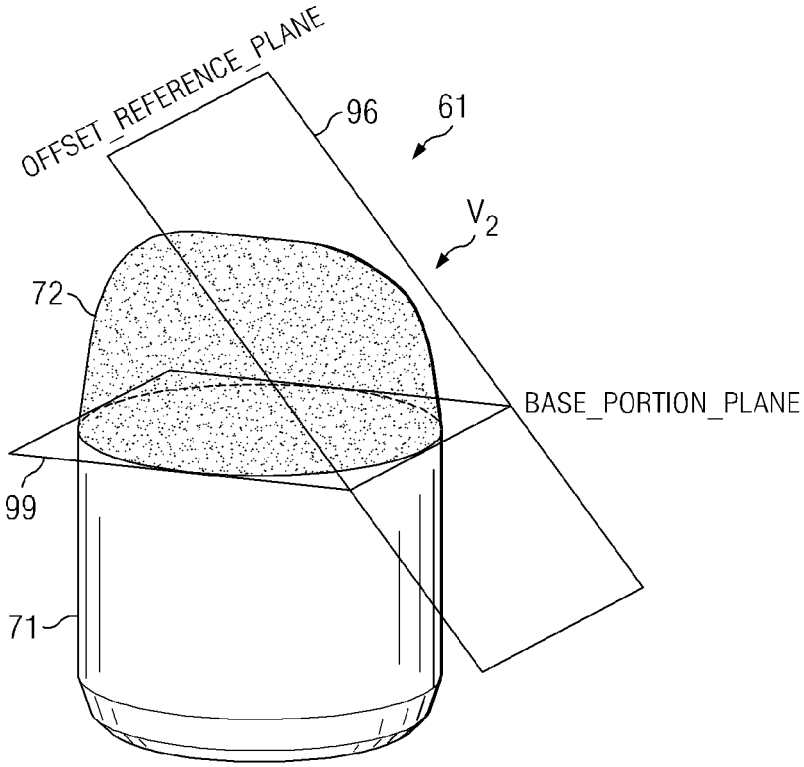
FIG. 10 is a perspective view of the gage cutting element of FIG. 4 illustrating the volume of the cutting portion.

Referring now to FIGS. 6, 9, and 10, the "sharpness," and hence cutting effectiveness of a particular gage cutting element (e.g., conventional gage cutting element 61) may also be quantified by a "cutting tip volumetric ratio" equal to the ratio of (a) the tip volume of the cutting portion to (b) the volume of the entire cutting portion (i.e., volume of the portion of the gage cutting element extending from the base portion to the extension height). As used herein, the phrase "tip volume" refers to the volume of the tip of the cutting portion of the gage cutting element defined by an offset reference plane extending through the cutting portion. In other words, the tip volume is the volume of the cutting portion extending between the base reference plane and the offset reference plane. For example, gage cutting element 61 has a tip volume $V_1$ (FIG. 9) extending between first offset reference plane 96 disposed at offset distance $d_{96}$ and base reference plane 95 (FIG. 6), and cutting portion 72 has a total volume $V_2$ (FIG. 10). The cutting tip volumetric ratio of gage cutting element 61 at offset distance $d_{96}$ is $V_1/V_2$. For most conventional gage cutting elements (e.g., gage cutting element 61), the cutting tip volumetric ratio between the base reference plane and an offset reference plane disposed at an offset distance equal to 10% of the insert extension height is greater than about 0.9%; and the cutting tip volumetric ratio between the base reference plane and an offset reference plane disposed at an offset distance equal to 15% of the insert extension height is greater than about 2%.

Figure 11:
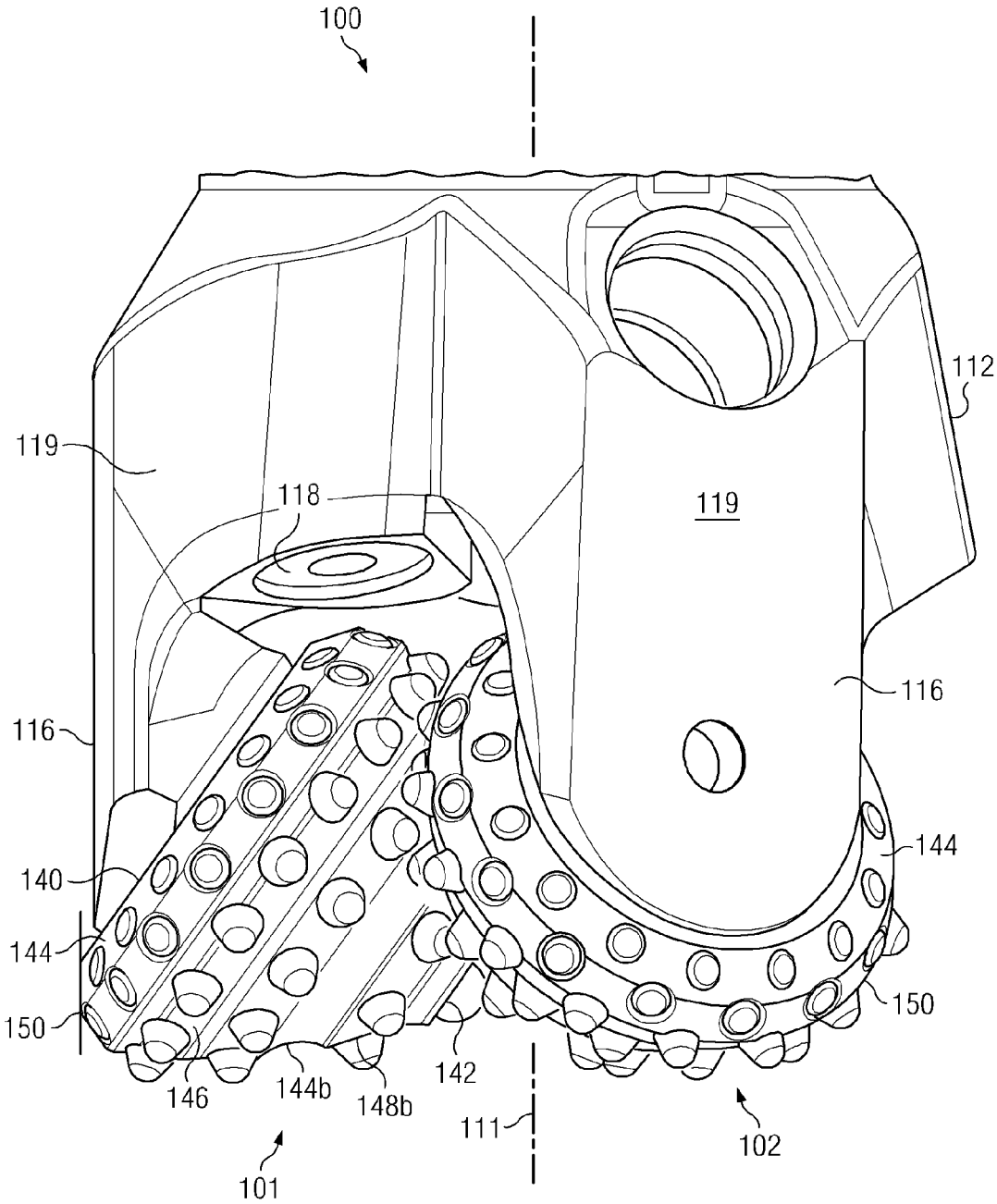
FIG. 11 is a perspective view of an embodiment of an earth-boring bit made in accordance with the principles described herein.
Figure 12:
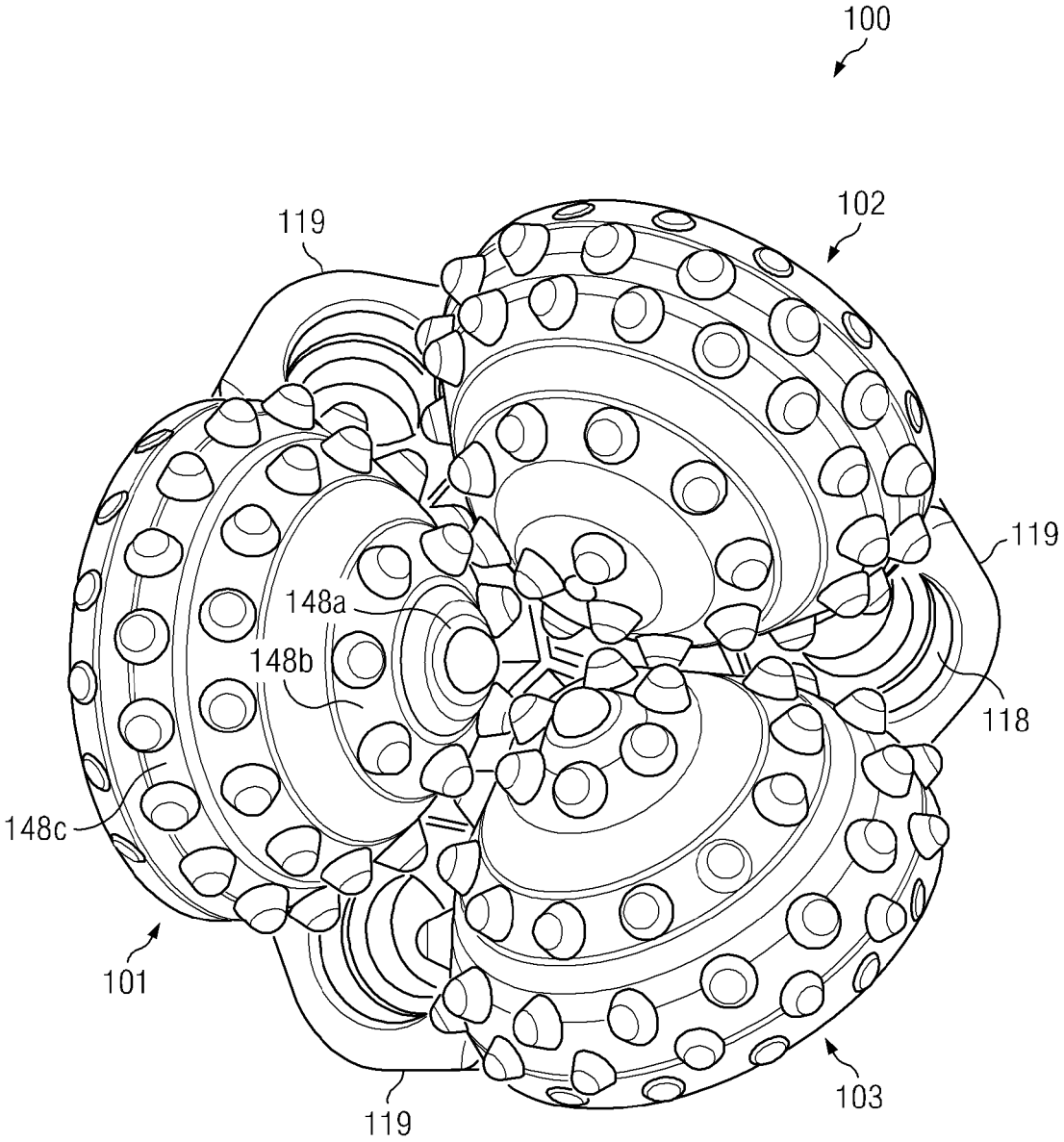
FIG. 12 is a bottom view of the bit of FIG. 11.
Figure 13:
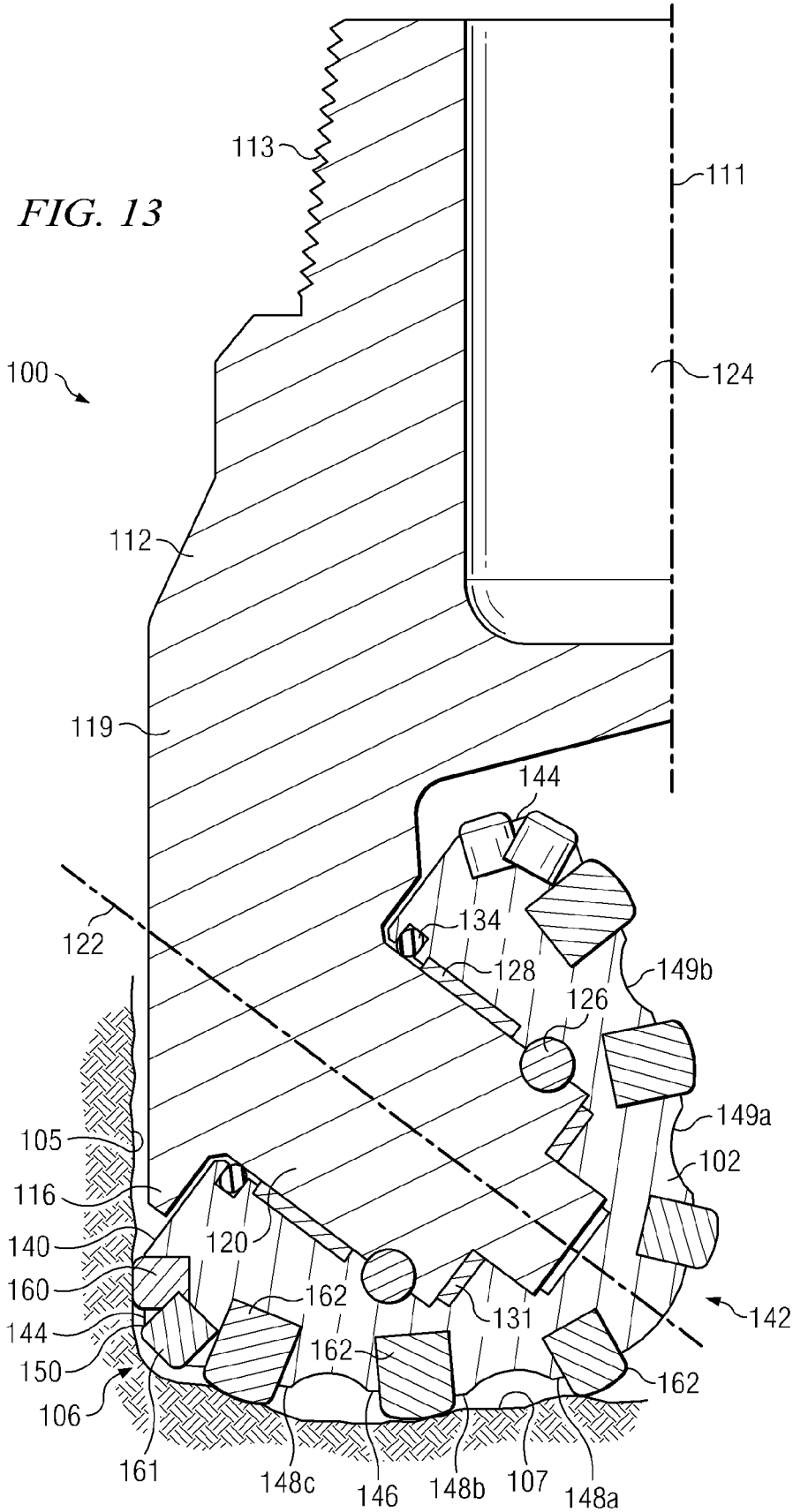
FIG. 13 is a partial section view taken through one leg and one rolling cone cutter of the bit shown in FIG. 11.

Referring now to FIGS. 11-13, an embodiment of an earth-boring bit 100 constructed in accordance with the principles described herein is shown. Bit 100 includes a central bit axis 111 and a bit body 112 having a threaded section (not shown) at its upper end that is adapted for securing the bit 100 to a drill string (not shown). Bit 100 has a predetermined gage diameter, defined by the outermost reaches of three rolling cone cutters 101, 102, 103 (cones 101 and 102 are visible in FIG. 11) which are rotatably mounted on bearing shafts that depend from the bit body 112. Bit body 112 is composed of three sections or legs 119 (two legs are visible in FIG. 11) that are welded together to form bit body 112. Bit 100 further includes a plurality of nozzles 118 that are provided for directing drilling fluid toward the bottom of the borehole and around cone cutters 101-103. Bit legs 119 include a shirttail portion 116 that serves to protect the cone bearings and cone seals from damage caused by cuttings and debris entering between leg 119 and its respective cone cutter. Although the embodiment illustrated in FIG. 11 shows bit 100 as including three cone cutters 101-103, in other embodiments, bit 100 may include any number of cone cutters, such as one, two, three, or more cone cutters.

Referring now to both FIGS. 11 and 13, each cone cutter 101-103 is mounted on a pin or journal 120 extending from bit body 112, and is adapted to rotate about a cone axis of rotation 122 oriented generally downwardly and inwardly toward the center of the bit. Each cutter 101-103 is secured on pin 120 by locking balls 126, in a conventional manner. In the embodiment shown, radial thrust and axial thrust are absorbed by journal sleeve 128 and thrust washer 131. The bearing structure shown is generally referred to as a journal bearing or friction bearing; however, the invention is not limited to use in bits having such structure, but may equally be applied in a roller bearing bit where cone cutters 101-103 would be mounted on pin 120 with roller bearings disposed between the cone cutter and the journal pin 120. In both roller bearing and friction bearing bits, lubricant may be supplied from reservoir 117 to the bearings by apparatus and passageways that are omitted from the figures for clarity. The lubricant is sealed in the bearing structure, and drilling fluid excluded therefrom, by means of an annular seal 134 which may take many forms. Drilling fluid is pumped from the surface through fluid passage 124 where it is circulated through an internal passageway (not shown) to nozzles 118 (FIG. 11). The borehole created by bit 100 includes sidewall 105, corner portion 106 and bottom 107, best shown in FIG. 13. As previously described, the mean effective stress around a borehole is generally greatest at the corner portion (e.g., corner portion 106). Consequently, as compared to sidewall 105 and bottom 107 of the borehole, corner portion 106 is generally harder and more difficult to cut.

Referring still to FIGS. 11 and 13, each cutter 101-103 includes a generally planar backface 140 and nose 142 generally opposite backface 140. Adjacent to backface 140, cutters 101-103 further include a generally frustoconical surface 144 that is adapted to retain cutting elements that scrape or ream the sidewalls of the borehole as the cone cutters 101-103 rotate about the borehole bottom. Frustoconical surface 144 will be referred to herein as the "heel" surface of cone cutters 101-103, it being understood, however, that the same surface may be sometimes referred to by others in the art as the "gage" surface of a rolling cone cutter.

Extending between heel surface 144 and nose 142 is a generally conical cone surface 146 adapted for supporting cutting elements that gouge or crush the borehole bottom 107 as the cone cutters rotate about the borehole. Frustoconical heel surface 144 and conical surface 146 converge in a circumferential edge or shoulder 150. Although referred to herein as an "edge" or "shoulder," it should be understood that shoulder 150 may be contoured, such as by a radius, to various degrees such that shoulder 150 will define a contoured zone of convergence between frustoconical heel surface 144 and the conical surface 146. Conical surface 146 is divided into a plurality of generally frustoconical regions 148*a-c*, generally referred to as "lands", which are employed to support and secure the cutting elements as described in more detail below. Grooves 149*a, b* are formed in cone surface 146 between adjacent lands 148*a-c*.

In bit 100 illustrated in FIGS. 11-13, each cone cutter 101-103 includes a plurality of wear resistant inserts or cutting elements 160, 161, 162. These cutting elements each include a generally cylindrical base portion with a central axis, and a cutting portion that extends from the base portion and includes a cutting surface for cutting formation material. The cutting surface may be symmetric or asymmetric relative to the central axis. All or a portion of the base portion is secured by interference fit into a mating socket formed in the surface of the cone cutter. The extension height of the insert or cutting element is the distance from the cone surface to the outermost point of the cutting surface of the cutting element as measured perpendicular to the cone surface. In general, the inserts or cutting elements of a rolling cone bit (e.g., inserts 160, 161, 162) may comprise any suitable material(s), including without limitation, tungsten carbide, steel, diamond, or combinations thereof.

Referring specifically to FIG. 13, exemplary cone 102 includes heel cutting elements 160 extending from heel surface 144. Heel cutting elements 160 are designed to ream the borehole sidewall 105. In this embodiment, heel cutting elements 160 are generally flat-topped elements, although alternative shapes and geometries may be employed. Moving axially with respect to cone axis 122 of cone 102, adjacent to shoulder 150, cone 102 includes gage cutting elements 161. It should be appreciated that gage cutting elements 161 are in a main gage row, as opposed to a binary gage row. In general, cutting elements in a binary gage row supports the main gage row in cutting borehole corner and prevent excessive wear on the adjacent main gage row inserts through sharing radial forces coming primarily from the borehole sidewall (e.g., sidewall 105). Usually binary inserts diameters are smaller in comparison to gage dimensions, and consequently, binary gage row cutting elements appear as a secondary row. Gage cutting elements 161 are designed to cut corner portion 106 of the borehole. In other words, gage cutting elements 161 are positioned and oriented to cut a portion of sidewall 105 and a portion of borehole bottom 107. As will be described in more detail below, compared to most conventional gage cutting elements (e.g., conventional gage cutting element 61), gage cutting elements 161 present a sharper cutting edge to the uncut formation, and thus, offer the potential for improved cutting effectiveness of the borehole corner (e.g., borehole corner 107) as compared to conventional gage cutting elements. Although gage cutting elements 161 are referred to herein as gage or gage row cutting elements, others in the art may describe such cutting elements as heel cutters or heel row cutters. Axially, between gage cutting elements 161 and nose 142, cone 102 includes a plurality of bottomhole cutting elements 162, also sometimes referred to as inner row cutting elements. Bottomhole cutting elements 162 are designed to cut the borehole bottom 107. In this embodiment, bottomhole cutting elements 162 include conventional cutting surfaces having a generally rounded chisel shape. Although only cone cutter 102 is shown in FIG. 13, cones 101 and 103 are similarly, although not identically, configured.

Figure 14:
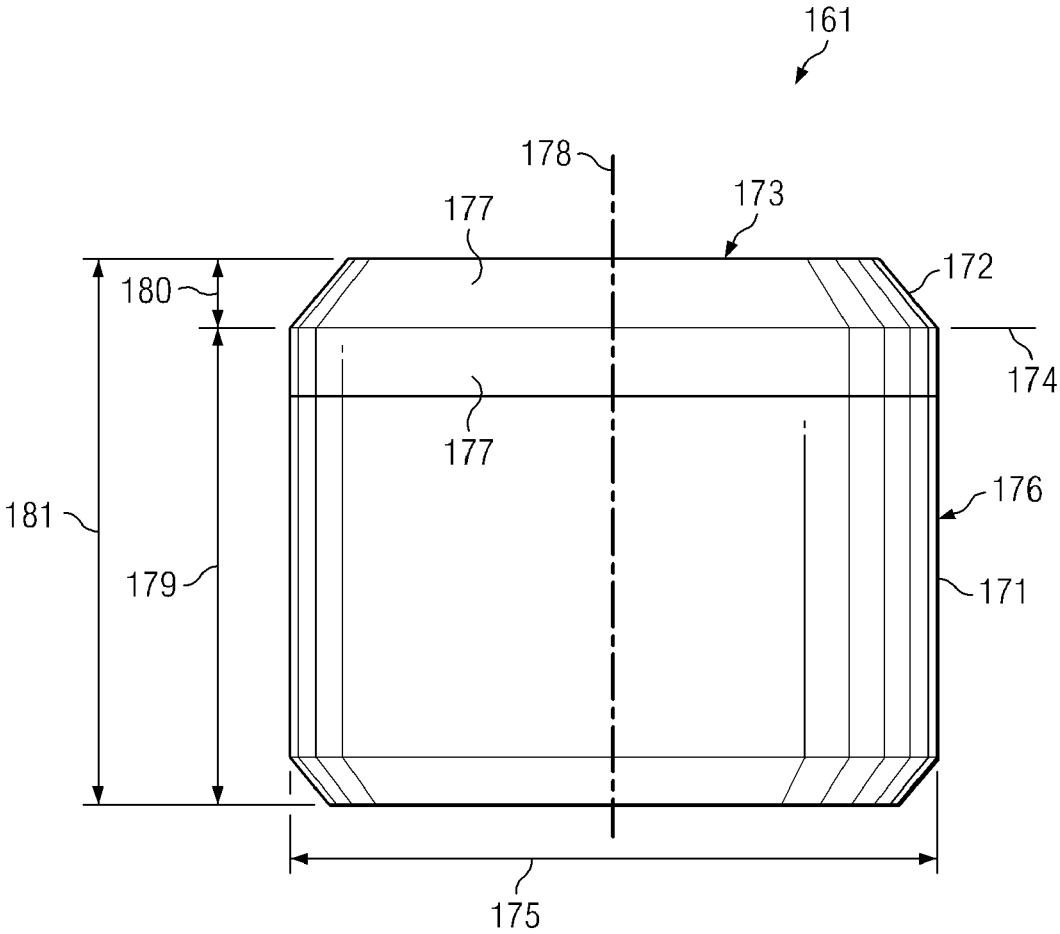
FIG. 14 is a side view one of the gage cutting elements employed in the gage row of the bit shown in FIG. 11.

Referring now to FIG. 14, an enlarged side view of one of unconventional gage cutting elements 161 is shown. Gage cutter element or insert 161 includes a base portion 171 and a cutting portion 172 extending therefrom. Cutting portion 172 includes a cutting surface 173 extending from a reference plane of intersection 174 that divides base 171 and cutting portion 172. In this embodiment, cutting surface 173 comprises a layer of diamond 177. Base portion 171 is generally cylindrical, having diameter 175, central axis 178, and an outer cylindrical surface 176. Further, base portion 171 has a height 179, and cutting portion 172 extends from base portion 171 to an extension height 180. Collectively, base 171 and cutting portion 172 define the insert's overall height 181. As conventional in the art, base portion 171 is preferably retained within a rolling cone cutter by interference fit, or by other means, such as brazing or welding, such that cutting portion 172 and cutting surface 173 extend beyond the cone steel. Once mounted, the extension height 180 of the cutter element 161 is generally the distance from the cone surface to the outermost point or portion of cutting surface 173 as measured perpendicular to the cone surface and generally parallel to the insert's axis 178. In this embodiment, each gage cutting element 161 has the same geometry (i.e., the same diameter 175, the same extension height 180, the same cutting surface geometry, etc.). However, in other embodiments, one or more of the gage cutting elements on the same or different cones may have a different geometry (e.g., different insert diameters, different extension heights, different cutting surface geometry, etc.).

Figure 15:
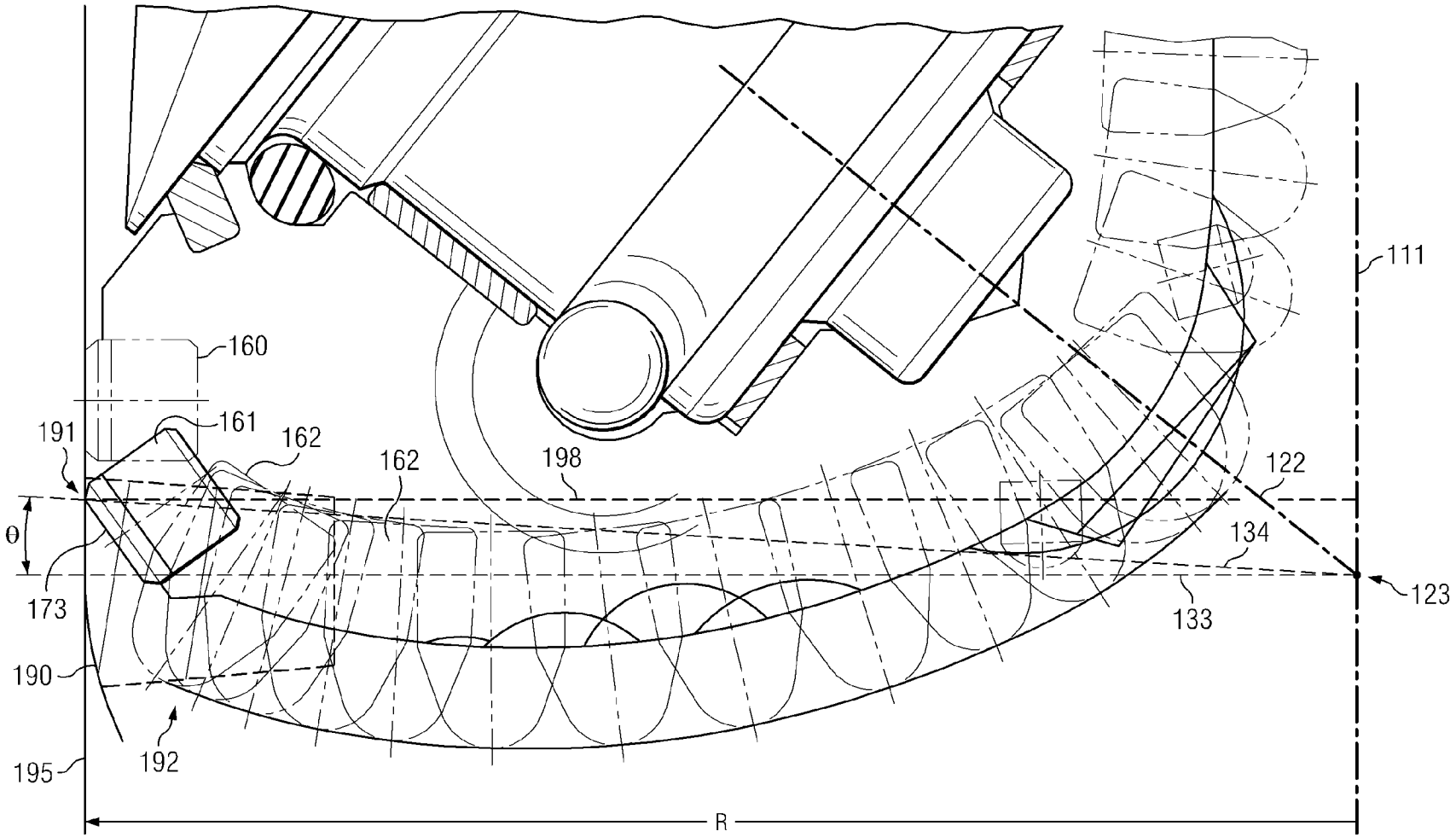
FIG. 15 is a schematic view showing, in composite rotated profile, the profiles of all of the cutting elements of the three cone cutters of the drill bit shown in FIG. 11.

Referring now to FIG. 15, the cutting surfaces, and hence cutting profiles, of each of the cutting elements 160, 161, 162 of all three cones 101-103 of bit 100 are shown in composite rotated profile view. As previously described, the composite rotated profile view shows all of the cutting elements of all three cones rotated into the layout plane that contains one of the cone or journal axes and is oriented parallel to the bit axis. In composite rotated profile view, the overlap of the profiles of cutting elements 160, 161, 162 on cones 101-103 are shown. Consequently, the composite rotated profile view illustrated in FIG. 15 shows the borehole coverage of the entire bit 100.

Figure 16:
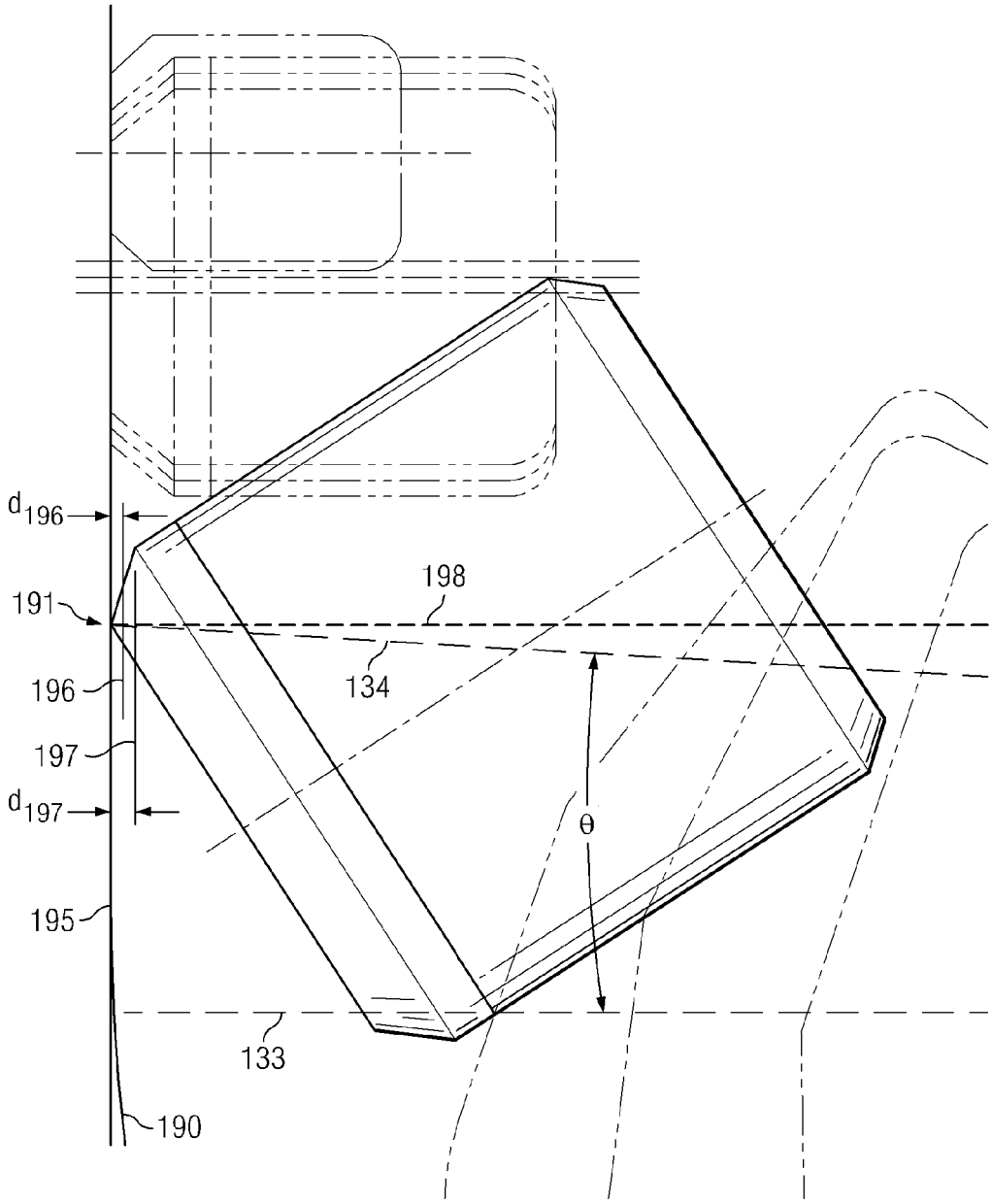
FIG. 16 is an enlarged view of the composite rotated profile of FIG. 15.

Referring now to FIGS. 15 and 16, a portion of a gage curve 190 is shown. Gage curve 190 is calculated and defined by a standard mathematical formulation known in the art which, based upon the parameters of bit diameter, journal angle, and journal offset, takes all the points that will cut the specified hole size, as located in three dimensional space, and projects these points into a two dimensional plane which contains the journal axis and is parallel to the bit axis (i.e., a layout plane). In addition, an oversize angle reference line 133 extends perpendicularly from bit axis 111 and passes through the intersection 123 of bit axis 111 and cone axis 122 in composite rotated profile view. Further, a gage curve contact point 191 represents the axially lowermost point (relative to bit axis 111) along gage curve 190 at which any cutting element contacts gage curve 190 in composite rotated profile view.

A base reference plane 195 is tangent to gage curve 190 at gage curve contact point 191 and is perpendicular to the layout plane in composite rotated profile view. First and second offset reference planes 196, 197 are parallel to base reference plane 195, but offset from base reference plane 195 by offset distances $d_{196}$, $d_{197}$, respectively, measured perpendicularly from base reference plane 195 in rotated profile view. An auxiliary plane 198 is perpendicular to base reference plane 195, perpendicular to the layout plane, and passes through gage curve contact point 191 in composite rotated profile view. Thus, the layout plane containing the composite rotated profile view, base reference plane 195, and auxiliary plane 198 are orthogonal.

Referring still to FIGS. 15 and 16, an oversize angle line 134 extends from intersection 123 of bit axis 111 and cone axis 122 to gage curve contact point 191 in composite rotated profile view. The oversize angle $\theta$ is the angle measured from the oversize angle reference line 133 to the oversize angle line 134 in composite rotated profile view. A zone of interest 192 (FIG. 15) is defined by an oversize angle $\theta$ between −15° and +15° and extends radially from 75% of the bit radius R and gage curve 190 in composite rotated profile view. Similar to zone of interest 92 previously described, zone of interest 192 generally identifies those cutting elements (in composite rotated profile view) with cutting surfaces that engage the formation at or proximal the borehole corner (e.g., corner 106), and thus, engage the relatively high effective stress regions of the borehole. As shown in FIG. 15, cutting surface 173 of each gage cutting element 161 is within zone of interest 192.

Figure 17:
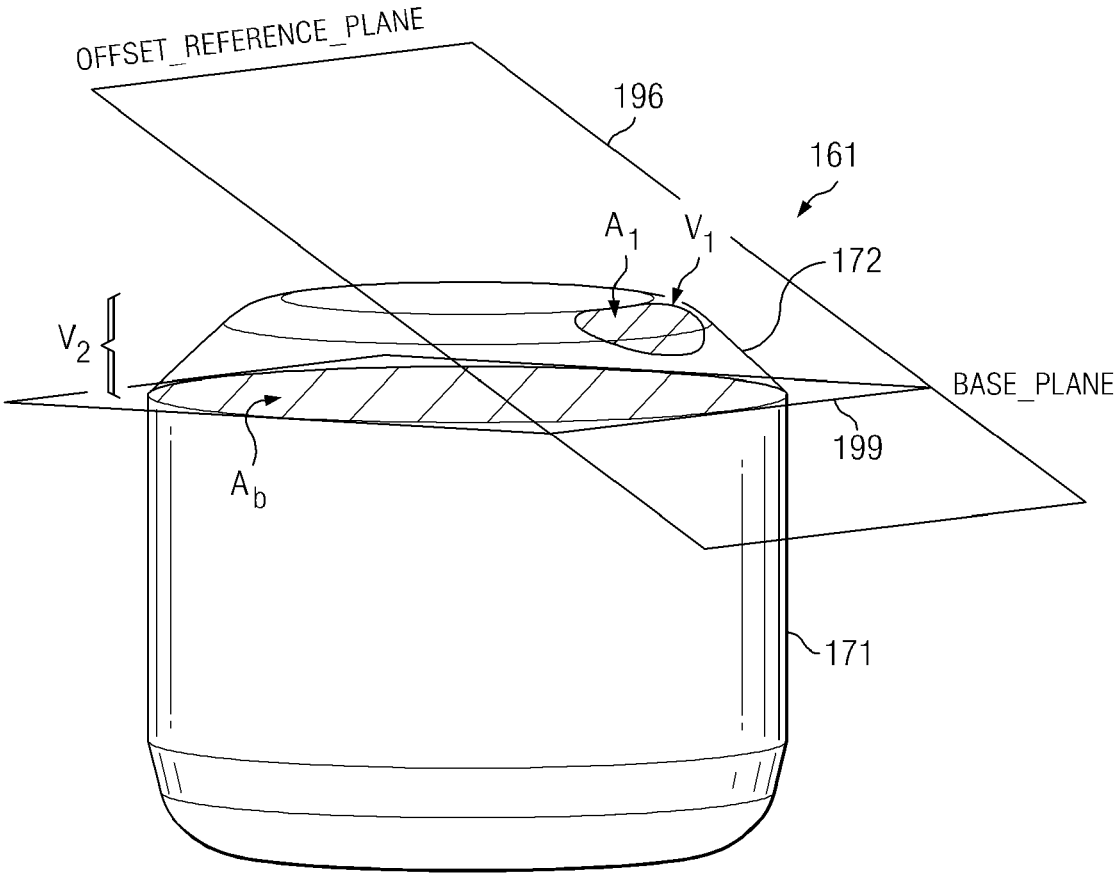
FIG. 17 is a perspective view of the gage cutting element of FIG. 14 illustrating the cross-sectional area of the cutting portion at an offset reference plane and the cross-sectional area of the base portion.

Referring now to FIGS. 16 and 17, the "sharpness," and hence cutting effectiveness of a gage cutting element 161 may be quantified by its cutting tip cross-sectional area ratio. As previously described, the cutting tip cross-sectional area ratio is equal to the ratio of (a) the cross-sectional area of the cutting portion of the gage cutting element at an offset reference plane extending through the cutting portion to (b) the cross-sectional area of the base portion of the gage cutting element at a plane perpendicular to the central axis and extending through the base portion. For example, gage cutting element 161 has a cross-sectional area $A_1$ (FIG. 17) at first offset reference plane 196 disposed at offset distance $d_{196}$ in cutting portion 172 (FIG. 16), and a cross sectional area $A_b$ at a base plane 199 that is perpendicular to base axis 178 in base portion 171. The cutting tip cross-sectional area ratio of gage cutting element 161 at offset distance $d_{196}$ is $A_1/A_b$. It should be appreciated that since base portion 171 is cylindrical, the cross-sectional area of base portion 171 at any plane perpendicular to axis 178 is the same.

In general, the lower the cutting tip cross-sectional area ratio at a particular offset distance, the sharper the cutting element, and the greater its potential cutting effectiveness, particularly as to the relatively hard and difficult to cut borehole corner. As previously described, most conventional gage cutting elements (e.g., gage cutting element 61 previously described) have a cutting tip cross-sectional area ratio that is greater than about 12% at an offset reference plane disposed at an offset distance equal to 10% of the insert extension height, and a cutting tip cross-sectional area ratio that is greater than about 19.5% at an offset reference plane disposed at an offset distance equal to 15% of the insert extension height. For enhanced sharpness as compared to such conventional gage cutting elements, embodiments described herein include gage cutting elements configured, positioned and oriented in each rolling cone cutters to have a cutting tip cross-sectional area ratio preferably less than or equal to 11%, and more preferably less or equal to 7%, at an offset reference plane disposed at an offset distance equal to 10% of the insert extension height; and a cutting tip cross-sectional area ratio less than or equal to 19%, and more preferably less or equal to 11%, at an offset reference plane disposed at an offset distance equal to 15% of the insert extension height. In this embodiment, gage cutting elements 161 mounted to bit 100 are configured, positioned, and oriented in each rolling cone cutter 101-103 to have a cutting tip cross-sectional area ratio less than about 4% at an offset reference plane disposed at an offset distance equal to 10% of the insert extension height, and a cutting tip cross-sectional area ratio less than about 6.5% at an offset reference plane disposed at an offset distance equal to 15% of the insert extension height.

Referring still to FIGS. 16 and 17, the "sharpness," and hence cutting effectiveness of a particular gage cutting element may also be quantified by its cutting tip volumetric ratio. As previously described, the cutting tip volumetric ratio is equal to the ratio of (a) the tip volume of the cutting portion to (b) the volume of the entire cutting portion (i.e., volume of the portion of the gage cutting element extending from the base portion to the extension height). For example, gage cutting element 161 has a tip volume $V_1$ (FIG. 17) extending between first offset reference plane 196 disposed at offset distance $d_{196}$ and base reference plane 195 (FIG. 16), and cutting portion 172 has a total volume $V_2$ (FIG. 17). The cutting tip volumetric ratio of gage cutting element 161 at offset distance $d_{196}$ is $V_1/V_2$.

Similar to the cutting tip cross-sectional area ratio at a given offset distance, the lower the cutting tip volumetric ratio at a given offset distance, the sharper the cutting element, and the greater its potential cutting effectiveness, particularly as to the relatively hard and difficult to cut borehole corner. As previously described, most conventional gage cutting elements (e.g., gage cutting element 61), have a cutting tip volumetric ratio between the base reference plane and an offset reference plane disposed at an offset distance equal to 10% of the insert extension height that is greater than about 0.9%; and the cutting tip volumetric ratio between the base reference plane and an offset reference plane disposed at an offset distance equal to 15% of the insert extension height that is greater than about 2%. For enhanced sharpness as compared to such conventional gage cutting elements, embodiments described herein include gage cutting elements configured, positioned, and oriented to have a cutting tip volumetric ratio preferably less than or equal to about 0.8%, and more preferably less or equal to 0.5%, at an offset reference plane disposed at an offset distance equal to 10% of the insert extension height; and a cutting tip volumetric ratio less than or equal to about 1.8%, and more preferably less or equal to 1.1% at an offset reference plane disposed at an offset distance equal to 15% of the insert extension height. In this embodiment, gage cutting elements 161 of bit 100 are configured, positioned, and oriented in each rolling cone cutter 101-103 to have a cutting tip volumetric ratio less than about 0.28% at an offset reference plane disposed at an offset distance equal to 10% of the insert extension height, and a cutting tip cross-sectional area ratio less than about 0.65% at an offset reference plane disposed at an offset distance equal to 15% of the insert extension height.

Figure 18:
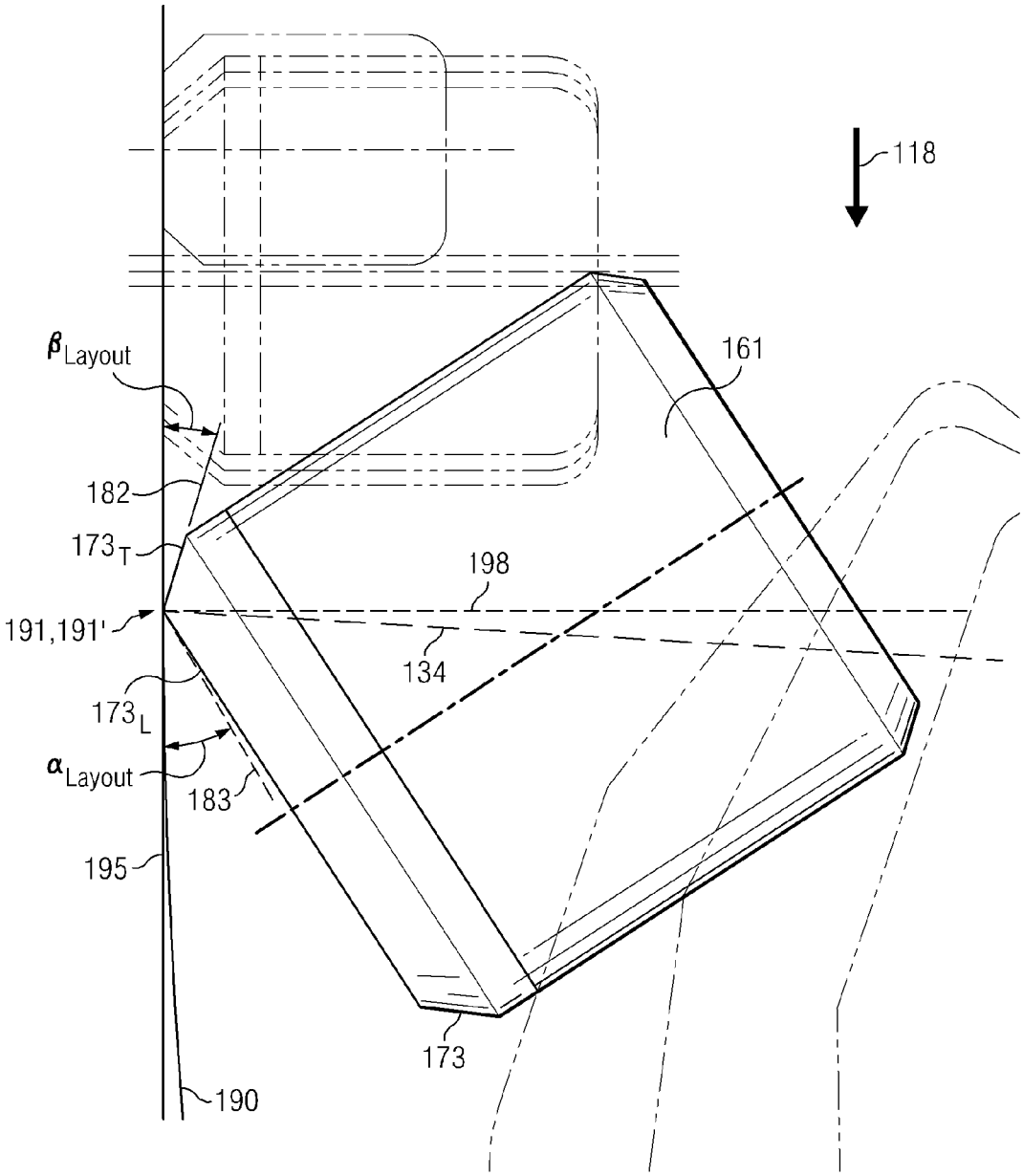
FIG. 18 is a layout plane view of one of the gage cutting elements of FIG. 11.

Referring now to FIG. 18, during drilling operations, bit 100 is rotated about bit axis 111 and each cone cutter 101-103 is rotated about its respective cone axis 122. As a result of the combined effects of the rotation of bit 100 and cones 101-103, each gage cutting element 161 has a cutting direction represented by arrow 118 as it approaches and engages the formation. It should be appreciated that cutting direction 118 is a vector in three dimensional space with components in the layout plane, auxiliary plane, and reference plane. In FIG. 18, cutting direction 118 and gage cutting element 161 are shown in the layout plane view (i.e., shown as they would appear looking perpendicular to the layout plane).

Referring still to FIG. 18, in this embodiment, each gage cutting element 161 includes a cutting edge 191' coincident with gage curve contact point 191. Cutting edge 191' represents the point or region of cutting portion 172 that first engages, and leads gage cutting element 161 into the formation as gage cutting element 161 moves in cutting direction 118. In addition, cutting surface 173 of cutting portion includes a leading adjacent surface $\mathbf{173}_L$ that extends from cutting edge 191' and leads cutting edge 191' relative to the cutting direction 118, and a trailing adjacent surface $\mathbf{173}_T$ that extends from cutting edge 191' and trails cutting edge 191' relative to cutting direction 118.

In the layout plane view of FIG. 18, a front leading angle $\alpha_{Layout}$ defines the angle between reference plane 195 and a line 183 tangent to leading adjacent surface $\mathbf{173}_L$ in composite rotated profile view (i.e., layout plane view). Further, a side trailing angle $\beta_{Layout}$ defines the angle between reference plane 195 and a line 182 tangent to trailing adjacent surface $\mathbf{173}_T$ in the composite rotated profile view (i.e., layout plane view). Embodiments of bits described herein preferably include gage cutting elements configured, positioned and oriented such that the front leading angle in the layout plane view (i.e., shown as they would appear looking perpendicular to the layout plane) (e.g., front leading angle $\alpha_{Layout}$) is greater than 20°, and more preferably greater than 25°; and/or the side trailing angle in the layout plane view (e.g., side trailing angle $\beta_{Layout}$) is preferably greater than 5°, and more preferably greater than 10°. In the embodiment shown in FIG. 18, front leading angle $\alpha_{Layout}$ is about 32° and side trailing angle $\beta_{Layout}$ is about 12°. It should be appreciated that the front leading angles in the layout plane, and the side trailing angles in the layout plane may vary depending on a variety of factors including, without limitation, insert geometry, insert positioning, insert orientation, journal angle, cone offset, oversize angle, or combinations thereof.

Figure 19:
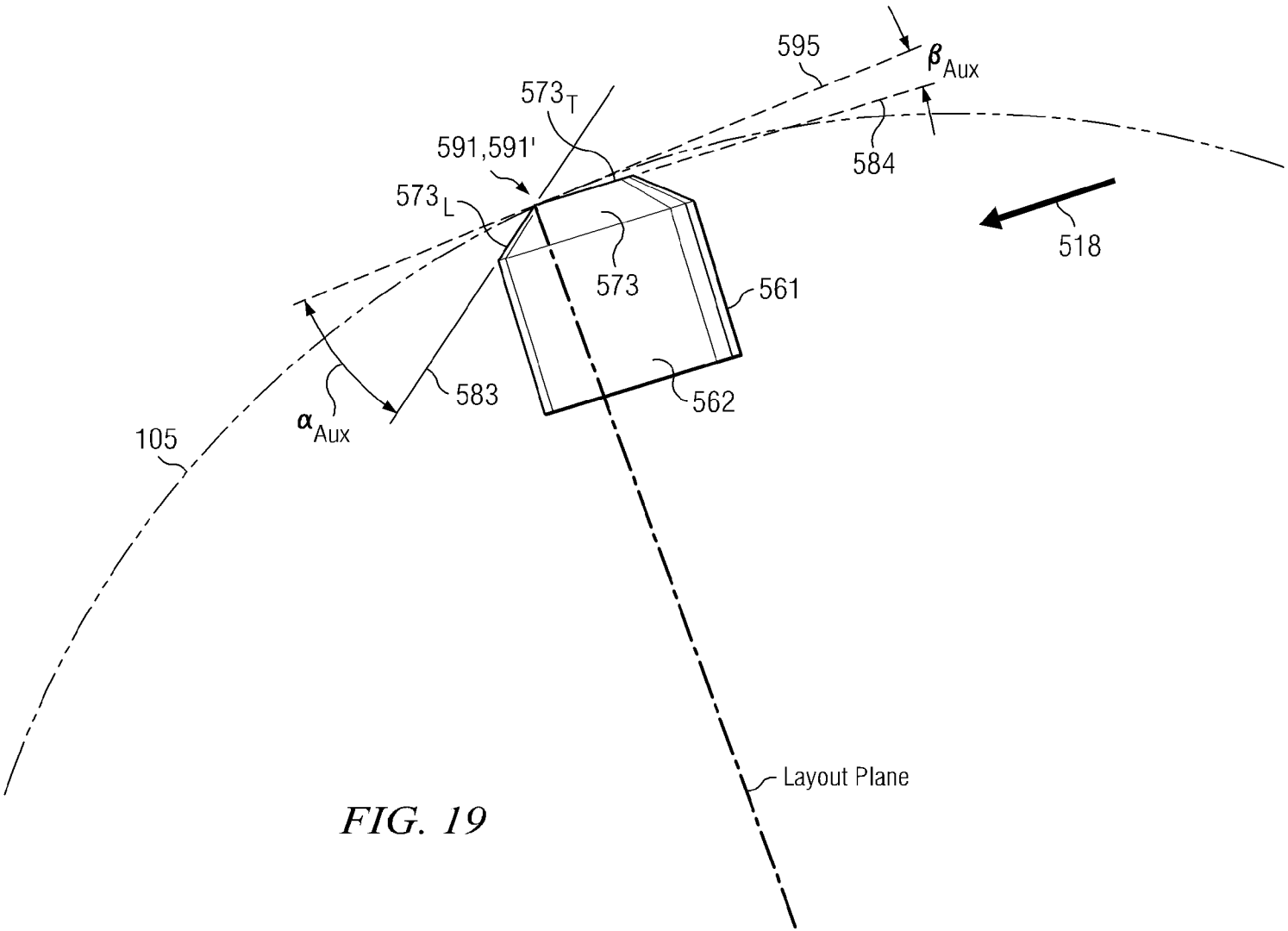
FIG. 19 is an auxiliary plane view of a gage cutting element of an embodiment of a bit made in accordance with the principles described herein.

Referring now to FIG. 19, the cutting action of a gage cutting element 561 having a cutting direction 518 is shown in the auxiliary plane view (i.e., shown as it would appear looking perpendicular to the auxiliary plane). It should be appreciated that cutting direction 518 is a vector in three dimensional space with components in the layout plane, auxiliary plane, and reference plane. In FIG. 19, cutting direction 518 and gage cutting element 561 are shown in the auxiliary plane view.

Gage cutting element 561 has a cylindrical base portion 562 and a cutting portion 572 extending from base portion 562. In addition, gage cutting element 561 has a cutting surface 573 with a cutting edge 591' coincident with a gage curve contact point 591. Cutting edge 591' represents the point or region of cutting portion 572 that first engages, and leads gage cutting element 561 into the formation as gage cutting element 561 moves in cutting direction 518. Cutting surface 573 of cutting portion 572 includes a leading adjacent surface $\mathbf{573}_L$ that extends from cutting edge 591' and leads cutting edge 591' relative to the cutting direction 518, and a trailing adjacent surface $\mathbf{573}_T$ that extends from cutting edge 591' and trails cutting edge 591' relative to cutting direction 518.

Referring still to FIG. 19, in the auxiliary plane view, a front leading angle $\alpha_{Aux}$ defines the angle between a base reference plane 595 defined as previously described for base reference planes 95 and 195, and a line 583 tangent to leading adjacent surface $\mathbf{573}_L$ in auxiliary plane view. Further, a side trailing angle $\beta_{Aux}$ defines the angle between reference plane 595 and a line 584 tangent to trailing adjacent surface $\mathbf{573}_T$ in the auxiliary plane view. Embodiments of bits described herein preferably include gage cutting elements configured, positioned and oriented such that the front leading angle in the auxiliary plane view (i.e., shown it would appear looking perpendicular to the auxiliary plane) (e.g., front leading angles $\alpha_{Aux}$) is greater than 20°, and more preferably greater than 25°; and/or the side trailing angle in the auxiliary plane view (e.g., side trailing angle $\beta_{Aux}$) is preferably greater than 5°, and more preferably greater than 10°. It should be appreciated that the front leading angles in the auxiliary plane, and the side trailing angles in the auxiliary plane may vary depending on a variety of factors including, without limitation, insert geometry, insert positioning, insert orientation, journal angle, cone offset, oversize angel, or combinations thereof.

Without being limited by this or any particular theory, the front leading angle $\alpha_{Layout}$, $\alpha_{Aux}$ in layout and auxiliary plane views, respectively, is generally related to cutting efficiency and durability. In general, smaller front leading angles $\alpha_{Layout}$, $\alpha_{Aux}$ increase gage cutting element durability while larger front leading angles $\alpha_{Layout}$, $\alpha_{Aux}$ provide greater rock shearing efficiency. Without being limited by this or any particular theory, the side trailing angle $\beta_{Layout}$, $\beta_{Aux}$ is related to the tensile stresses the borehole induces on the gage cutting element.

Embodiments of bits constructed in accordance with the principle described herein include main gage cutting elements (e.g., gage cutting elements 161) configured, positioned, and oriented in each rolling cone cutter (e.g., rolling cone cutters 101-103) to have (a) a cutting tip cross-sectional area ratio preferably less than or equal to 11%, and more preferably less or equal to 7%, at an offset reference plane disposed at an offset distance equal to 10% of the insert extension height; and a cutting tip cross-sectional area ratio preferably less than or equal to 19%, and more preferably less or equal to 11%, at an offset reference plane disposed at an offset distance equal to 15% of the insert extension height; (b) a cutting tip volumetric ratio preferably less than or equal to 0.8%, and more preferably less or equal to 0.5%, at an offset reference plane disposed at an offset distance equal to 10% of the insert extension height; and a cutting tip volumetric ratio preferably less than or equal to 1.8%, and more preferably less or equal to 1.1%, at an offset reference plane disposed at an offset distance equal to 15% of the insert extension height; (c) a front leading angle in the layout plane view or auxiliary plane view (e.g., front leading angle $\alpha_{Layout}$ or front leading angles $\alpha_{Aux}$) preferably greater than 20°, and more preferably greater than 25°; and a side trailing angle in the layout plane view or auxiliary plane view (e.g., side trailing angle $\beta_{Layout}$ or side trailing angle $\beta_{Aux}$) greater than 5°, and more preferably greater than 10°; or (d) combinations thereof. In the embodiment of bit 100 shown in FIGS. 11 and 12, each gage cutting element 161 on each cone 101-103 is configured, positioned, and oriented to include these preferred characteristics (i.e., the preferred cutting tip cross-sectional area ratios, cutting tip volumetric ratios, front leading angles in layout plane view or front leading angles in auxiliary plane view and side trailing angle in layout plane view or side trailing angle in auxiliary plane view).

Although one particular geometry, position, and orientation for gage cutting element 161 is shown in FIGS. 11-19, it should be appreciated that other gage cutting elements with different geometries, positions, and/or orientations may result in similar cutting tip cross-sectional area ratios, cutting tip volumetric ratios, front leading angles in the layout view, front leading angles in the auxiliary plane view, side trailing angles in the layout view, side trailing angles in the auxiliary view, or combinations thereof.

Moreover, as previously described, zone of interest 192 generally identifies those cutting elements (in composite rotated profile view) with cutting surfaces that engage the relatively high effective stress regions of the borehole. Consequently, although embodiments described herein have focused on the configuration, position, and orientation of gage cutting elements (e.g., gage cutting elements 161), the preferred features may also be applied to any cutting element having a cutting surface extending into the zone of interest (e.g., zone of interest 192). For example, one or more bottom-hole cutting elements 162 adjacent to gage cutting elements 161 having cutting surfaces extending into zone of interest 192. Such bottom-hole cutting elements 162 may also be configured, positioned, and oriented to have (a) a cutting tip cross-sectional area ratio preferably less than or equal to 11%, and more preferably less or equal to 7%, at an offset reference plane disposed at an offset distance equal to 10% of the insert extension height; and a cutting tip cross-sectional area ratio preferably less than or equal to 19%, and more preferably less or equal to 11%, at an offset reference plane disposed at an offset distance equal to 15% of the insert extension height; (b) a cutting tip volumetric ratio preferably less than or equal to 0.8%, and more preferably less or equal to 0.5%, at an offset reference plane disposed at an offset distance equal to 10% of the insert extension height; and a cutting tip volumetric ratio preferably less than or equal to 1.8%, and more preferably less or equal to 1.1%, at an offset reference plane disposed at an offset distance equal to 15% of the insert extension height; (c) a front leading angle in the layout plane view or auxiliary plane view (e.g., front leading angle $\alpha_{Layout}$ or front leading angles $\alpha_{Aux}$) preferably greater than 20°, and more preferably greater than 25°; and a side trailing angle in the layout plane view or auxiliary plane view (e.g., side trailing angle $\beta_{Layout}$ or side trailing angle $\beta_{Aux}$) greater than 5°, and more preferably greater than 10°; or (d) combinations thereof. The relatively sharp geometry of the gage cutting elements and/or bottom-hole cutting elements configured, positioned, and oriented in accordance with embodiments described herein offer the potential to increase formation removal via shearing action, and increase cutting effectiveness and efficiency, while reducing detrimental loading. In addition, the relatively sharp geometry of the gage cutting elements and/or bottomhole cutting elements configured, positioned, and oriented in accordance with embodiments described herein offer the potential to reduce vertical impacts on the borehole bottom, which are generally known to be detrimental to superabrasive materials (e.g., diamond) bonded to the cutting surface of the cutting elements.

As shown in FIGS. 11, 12, and 15, gage cutting elements 161 on each cone 101-103 are arranged in a circumferential row, and further, each gage cutting element 161 on all cones 101-103 is disposed at the same radial position relative to bit axis 111 as viewed at its axially lowermost position relative to bit axis 111 (i.e., at the borehole bottom). Consequently, in composite rotated profile view of FIG. 15, the cutting profiles of gage cutting elements 161 completely overlap. However, in other embodiments, the gage cutting elements on a given cone and/or different cones may be arranged differently, yet still exhibit one or more of the preferred characteristics. For example, referring now to FIGS. 20A and 20B, the composite rotated profile view of an embodiment of a bit 200 is shown. Bit 200 is configured similar to bit 100 previously described. Namely, bit 200 includes a bit body having a central bit axis 211 and three rolling cone cutters 201-203, each cone cutter 201-203 adapted for rotation about a cone axis 222. Further, a plurality of heel cutting elements 260, gage cutting elements 261, and bottom-hole cutting elements 262 are mounted to each cone 201-203. Similar to gage cutting elements 161 previously described, gage cutting elements 261 on each cone 201-203 are arranged in a circumferential row. Thus, each gage cutting element 261 on a given cone 201-203 are disposed at the same radial position relative to bit axis 211. However, unlike gage cutting elements 161, in this embodiment, gage-cutting elements 261 on different cones 201-203 are disposed at different radial positions relative to bit axis 211 at their axially lowermost position relative to bit axis 211 (i.e., adjacent the borehole bottom). Consequently, the cutting profiles of gage cutting elements 261 on the same cone 201-203 completely overlap, however, the cutting profiles of gage cutting elements 261 on different cones 201-203 do not completely overlap in rotated profile view. Rather, the cutting profiles of gage cutting elements 261 on different cone 201-203 partially overlap to define a "fanned" arrangement as best shown in the enlarged view of the composite rotated profile view of FIG. 20B. For purposes of further explanation, gage cutting elements 261 on cones, 201, 202, 203 are assigned reference numerals 261-201, 261-202, 261-203, respectively. Gage cutting elements 261-201 are disposed in a circumferential row on cone 201, but are disposed at a different radial position in composite rotated profile view as compared to gage cutting elements 261-202 and gage cutting elements 261-203. Further, gage cutting elements 261-202 are disposed in a circumferential row on cone 202, but are disposed at a different radial position in composite rotated profile view as compared to gage cutting elements 261-203.

Figure 20A:
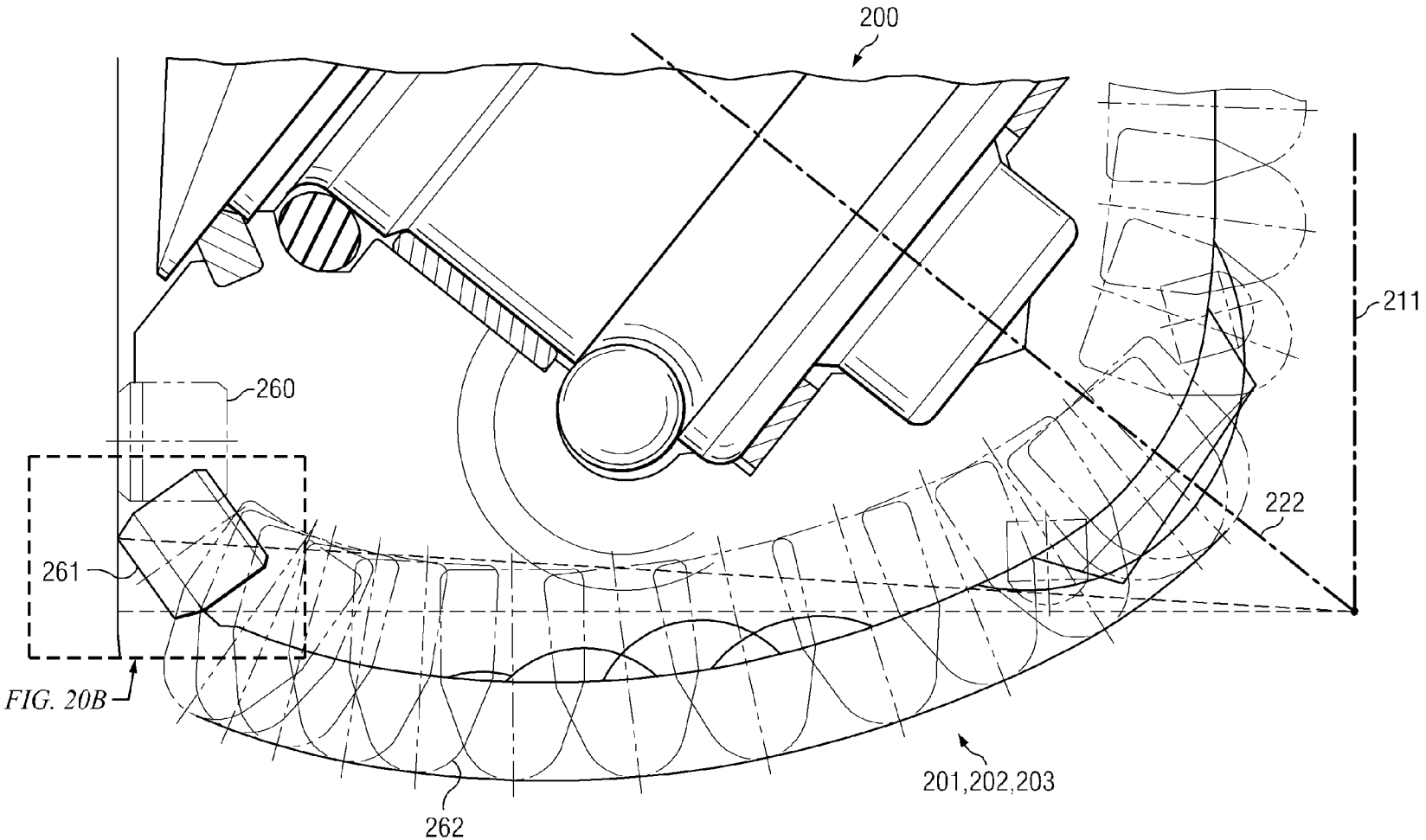
FIG. 20A is a composite rotated profile view of an embodiment of an earth-boring bit made in accordance with the principles described herein.
Figure 20B:
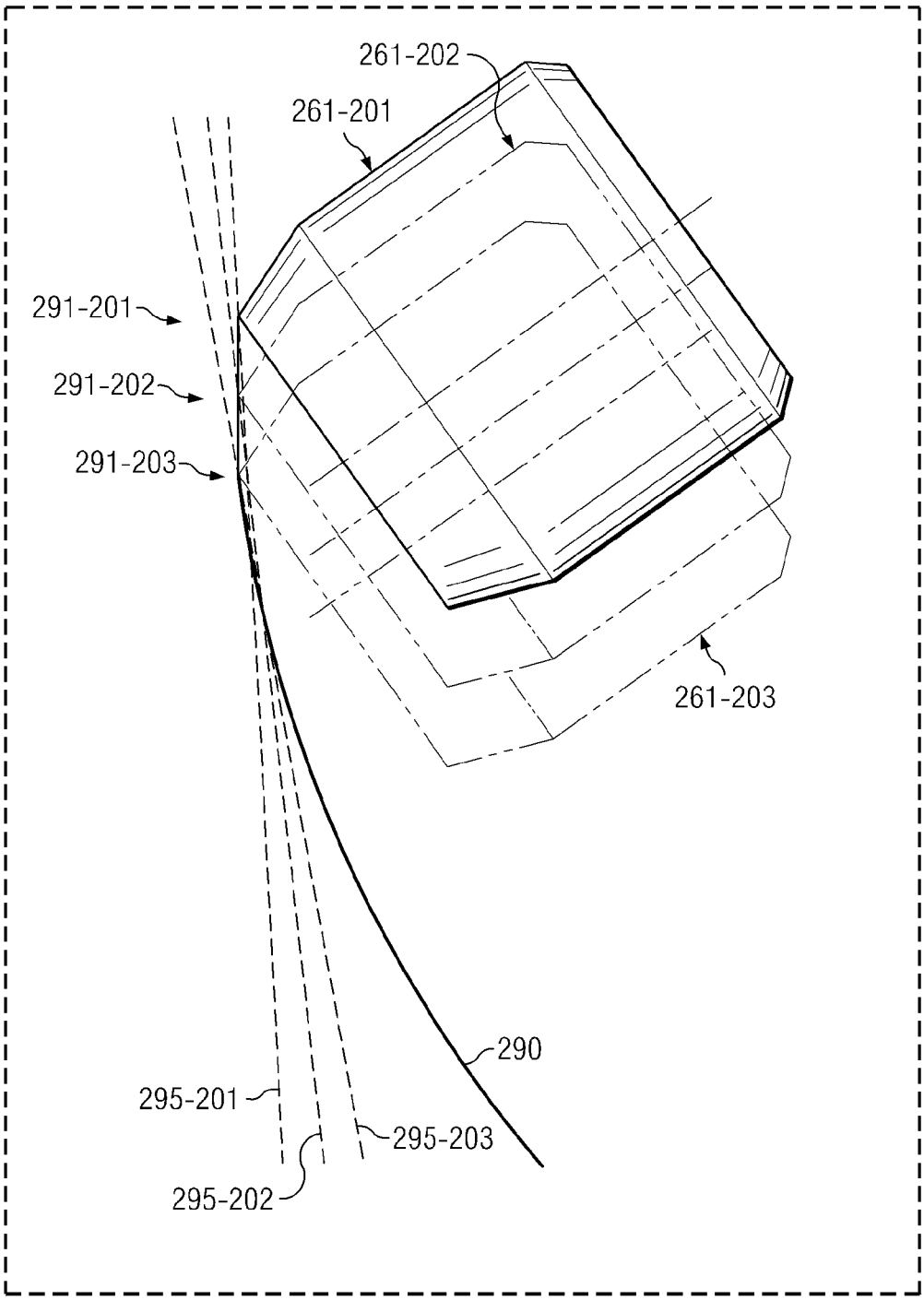
FIG. 20B is an expanded view of FIG. 20A.

Referring still to FIGS. 20A and 20B, although gage cutting elements 261-201, 261-202, 261-203 are disposed at different radial positions relative to bit axis 211 at their axially lowermost position, bit 200 has a single gage curve 290 determined according to conventional methods. Gage cutting elements 261-201, 261-202, 261-203 each have a gage curve contact point 291-201, 291-202, 291-203, respectively. Further, a first base reference plane 295-201 (tangent to gage curve 290 at gage curve contact point 291-201 and perpendicular to the layout plane in composite rotated profile view) is associated with gage cutting elements 261-201; a second base reference plane 295-202 (tangent to gage curve 290 at gage curve contact point 291-202 and perpendicular to the layout plane in composite rotated profile view) is associated with gage cutting elements 261-202, and a third base reference plane 295-203 (tangent to gage curve 290 at gage curve contact point 291-203 and perpendicular to the layout plane in composite rotated profile view) is associated with gage cutting elements 261-203. Offset reference planes, offset reference distances, front leading angles in the layout and auxiliary planes, and side trailing angles in the layout and auxiliary planes for gage cutting elements 261-201, 261-202, 261-203 are identified with respect to base reference planes 295-201, 295-202, 295-203, respectively. Main gage cutting elements 261 are preferably configured, positioned, and oriented in each rolling cone cutter (e.g., rolling cone cutters 201-203) to have (a) a cutting tip cross-sectional area ratio preferably less than or equal to 11%, and more preferably less or equal to 7%, at an offset reference plane disposed at an offset distance equal to 10% of the insert extension height; and a cutting tip cross-sectional area ratio preferably less than or equal to 19%, and more preferably less or equal to 11%, at an offset reference plane disposed at an offset distance equal to 15% of the insert extension height; (b) a cutting tip volumetric ratio preferably less than or equal to 0.8%, and more preferably less or equal to 0.5%, at an offset reference plane disposed at an offset distance equal to 10% of the insert extension height; and a cutting tip volumetric ratio preferably less than or equal to 1.8%, and more preferably less or equal to 1.1%, at an offset reference plane disposed at an offset distance equal to 15% of the insert extension height; (c) a front leading angle in the layout plane view or auxiliary plane view (e.g., front leading angle $\alpha_{Layout}$ or front leading angles $\alpha_{Aux}$) preferably greater than 20°, and more preferably greater than 25°; and a side trailing angle in the layout plane view or auxiliary plane view (e.g., side trailing angle $\beta_{Layout}$ or side trailing angle $\beta_{Aux}$) greater than 5°, and more preferably greater than 10°; or (d) combinations thereof.

In the embodiment shown in FIGS. 20A and 20B, gage cutting elements 261 on each cone 201-203 are arranged in a circumferential row, however, gage-cutting elements 261 on different cones 201-203 are disposed at different radial positions relative to bit axis 211 as viewed at their axially lowermost position relative to bit axis 211 (i.e., adjacent the borehole bottom). In other embodiments, the gage cutting elements on one or more given cones may be disposed at different radial positions, resulting in a similar composite rotated profile view as that shown in FIG. 20B. For example, the gage cutting elements on a specific cone may be arranged in a spiral arrangement wherein the plurality of gage cutting elements are disposed in one of two, three or more radial positions at their axially lowermost point. Further, in other embodiments, the gage cutting elements on the same or different cone may be oriented with different profile angles, where the profile angle is the angle between the central axis of the cutting element and a line perpendicular to the cone surface in composite rotated profile view.

As previously described and shown in FIG. 15, gage cutting elements 161 on each cone 101-103 each extend to and contact gage curve 90 at gage curve contact point 191 in composite rotated profile view. However, in other embodiments including one or more of the preferred characteristics, the gage cutting elements on a given cone and/or different cones may not extend to the gage curve, but rather, extend to an offset gage curve. For example, referring now to FIGS. 21A and 21B, the composite rotated profile view of an embodiment of a bit 300 is shown. Bit 300 is configured similar to bit 100 previously described. Namely, bit 300 includes a bit body having a central bit axis 311 and three rolling cone cutters 301-303, each cone cutter 301-303 adapted for rotation about a cone axis 322. Further, a plurality of heel cutting elements 360, gage cutting elements 361, and bottom-hole cutting elements 362 are provided on each cone 301-303. Similar to gage cutting elements 261 previously described, gage cutting elements 361 on different cones 301-303 are disposed at different radial positions relative to bit axis 311 as viewed at their axially lowermost position relative to bit axis 311 (i.e., at the borehole bottom). Consequently, the cutting profiles of gage cutting elements 361 do not completely overlap in rotated profile view, but rather are "fanned" as best shown in the enlarged view of the composite rotated profile view of FIG. 21B. For purposes of further explanation, gage cutting elements 361 on cones, 301, 302, 303 are assigned reference numerals 361-301, 361-302, 361-303, respectively.

Figure 21A:
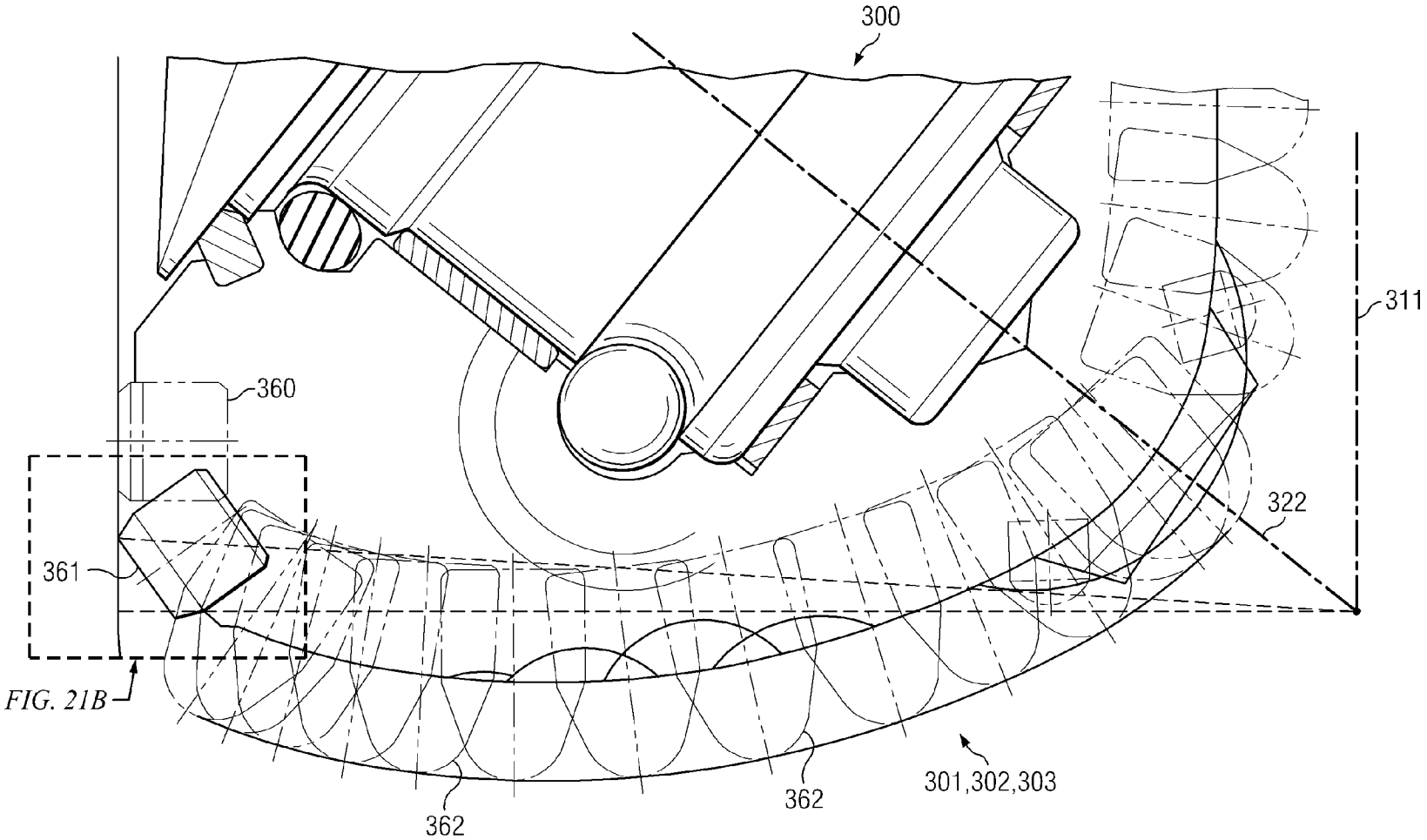
FIG. 21A is a composite rotated profile view of an embodiment of an earth-boring bit made in accordance with the principles described herein.
Figure 21B:
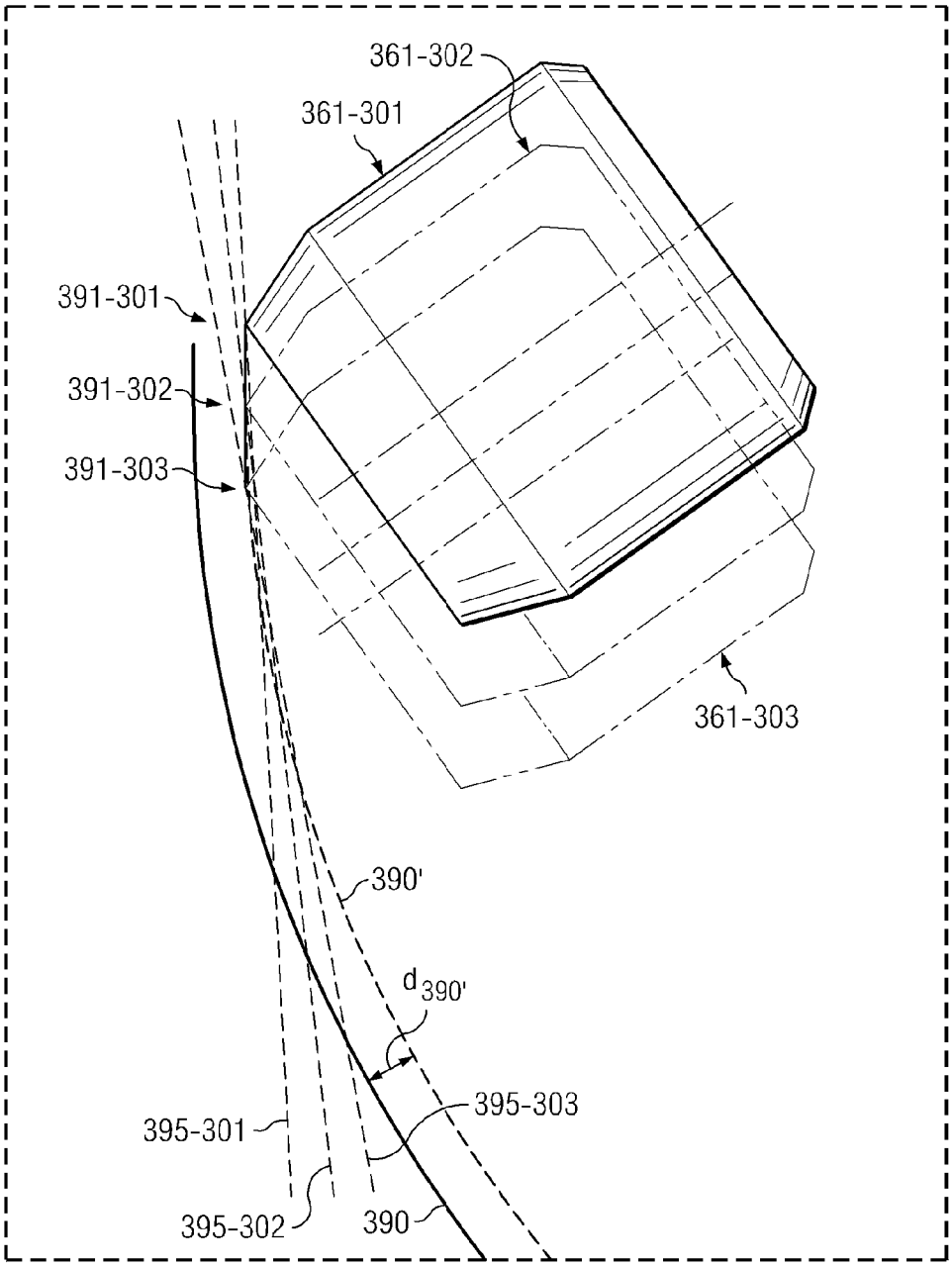
FIG. 21B is an expanded view of FIG. 20A.

Referring still to FIGS. 21A and 21B, bit 300 has a single gage curve 390 determined according to conventional methods. However, unlike gage cutting elements 261 previously described, in this embodiment, gage cutting elements 361 do not extend to gage curve 390. Rather, gage cutting elements 361 each extend to an offset gage curve 390' drawn using conventional gage curve calculations but using a bit diameter that differs from the actual bit diameter by an offset radial distance $d_{390'}$ measured perpendicular to bit axis 311 from gage curve 390. Gage cutting elements 361-301, 361-302, 361-303 contact offset gage curve 390' at offset gage curve contact points 391-301, 391-302, 391-303, respectively. As a result, a first base reference plane 395-301 associated with gage cutting elements 361-301, a second base reference plane 395-302 associated with gage cutting elements 361-302, and a third base reference plane 395-303 associated with gage cutting elements 361-303 are defined with respect to offset gage curve 390'. Offset reference planes, offset reference distances, front leading angles in the layout and auxiliary planes, and side trailing angles in the layout and auxiliary planes for gage cutting elements 361-301, 361-302, 361-303 are identified with respect to base reference planes 395-301, 395-302, 395-330, respectively. Main gage cutting elements 361 are preferably configured, positioned, and oriented in each rolling cone cutter (e.g., rolling cone cutters 301-303) to have (a) a cutting tip cross-sectional area ratio preferably less than or equal to 11%, and more preferably less or equal to 7%, at an offset reference plane disposed at an offset distance equal to 10% of the insert extension height; and a cutting tip cross-sectional area ratio preferably less than or equal to 19%, and more preferably less or equal to 11%, at an offset reference plane disposed at an offset distance equal to 15% of the insert extension height; (b) a cutting tip volumetric ratio preferably less than or equal to 0.8%, and more preferably less or equal to 0.5%, at an offset reference plane disposed at an offset distance equal to 10% of the insert extension height; and a cutting tip volumetric ratio preferably less than or equal to 1.8%, and more preferably less or equal to 1.1%, at an offset reference plane disposed at an offset distance equal to 15% of the insert extension height; (c) a front leading angle in the layout plane view or auxiliary plane view (e.g., front leading angle $\alpha_{Layout}$ or front leading angles $\alpha_{Aux}$) preferably greater than 20°, and more preferably greater than 25°; and a side trailing angle in the layout plane view or auxiliary plane view (e.g., side trailing angle $\beta_{Layout}$ or side trailing angle $\beta_{Aux}$) greater than 5°, and more preferably greater than 10°; or (d) combinations thereof. Although gage cutting elements 391 are positioned in a "fanned" arrangement on cones 301-303, in other embodiments, main gage cutting elements on different cones, disposed at the same radial position in composite rotated profile view at their axially lowermost position relative to the bit axis (i.e., not fanned), may be offset from the gage curve.

Figure 22:
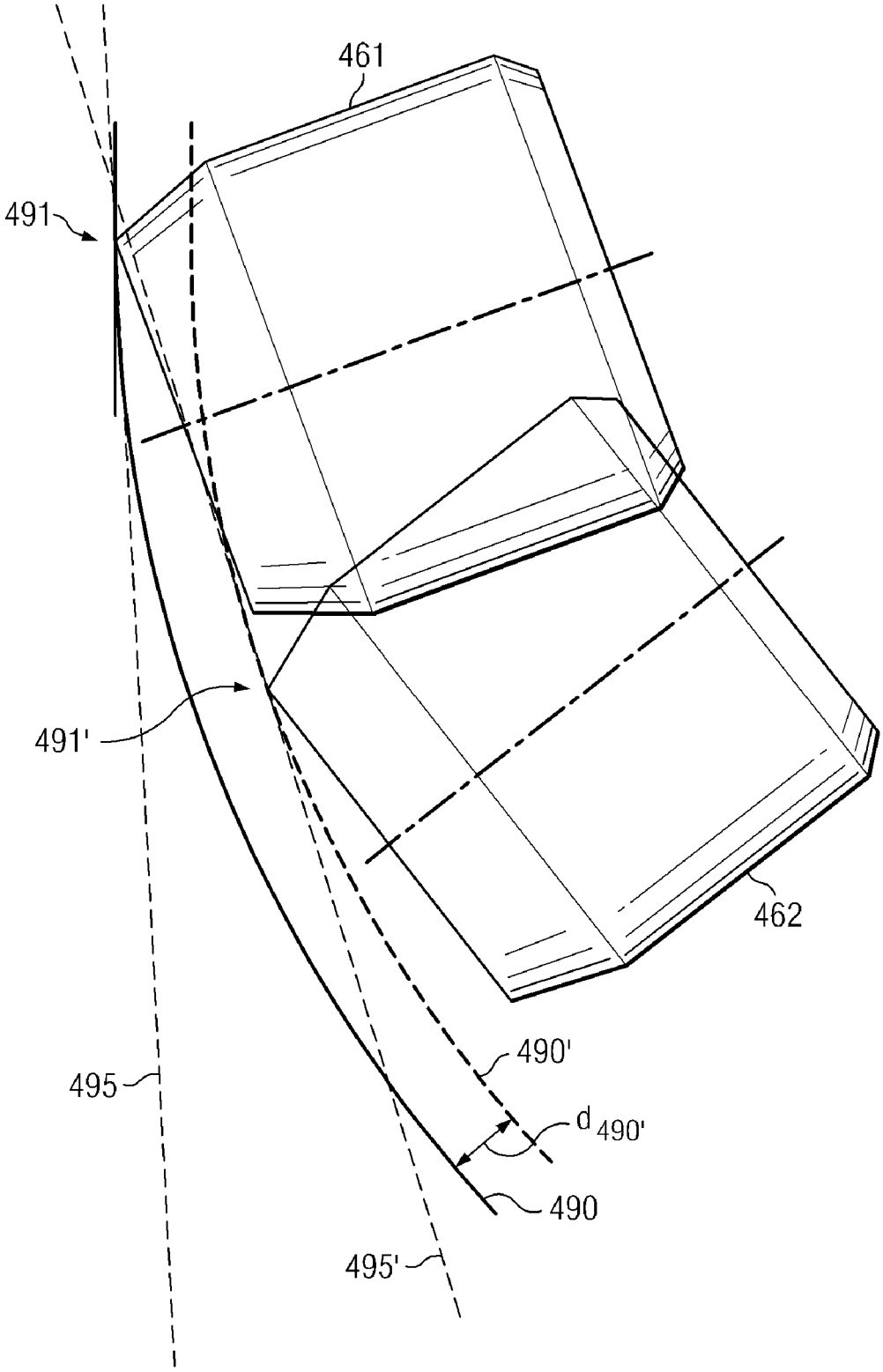
FIG. 22 is an enlarged partial composite rotated profile view of an embodiment of an earth-boring bit made in accordance with the principles described herein.

As previously described, the preferred features described herein (e.g., preferred cutting tip cross-sectional area ratios, cutting tip volumetric ratios, front leading angles in layout plane view, front leading angles in auxiliary plane view, side trailing angle in layout plane view, and side trailing angle in auxiliary plane view) may be applied to any cutting elements having a cutting surface extending into the zone of interest, including gage cutting elements and bottom-hole cutting elements disposed adjacent to gage. For example, referring now to FIG. 22, a partial composite rotated profile view of an embodiment of a rolling cone bit includes a plurality of gage cutting elements 461 arranged on a plurality of rolling cone cutters, and a plurality of bottom-hole cutting elements 462 arranged on the plurality of cone cutters. Gage cutting elements 461 extend to a gage curve 490 and bottom-hole cutter elements 462 radially adjacent to gage cutting elements 461 extend to an offset gage curve 490' that is radially offset from gage curve 490 by an offset distance $d_{490'}$ measured perpendicular to the bit axis from gage curve 490. Offset gage curve 490' is drawn using conventional gage curve calculations but using a bit diameter that differs from the actual bit diameter by an offset radial distance $d_{490'}$ measured from gage curve 490 perpendicular to the bit axis from gage curve 490. In particular, gage cutting elements 461 contact gage curve 490 at a gage curve contact point 491, and bottom-hole cutting elements 462 adjacent to gage cutting elements 461 contact offset gage curve 490' at an offset gage curve contact point 491'. A base reference plane 495 is associated with gage cutting elements 461, and a base reference plane 495' is associated with bottom-hole cutting elements 462. Offset reference planes, offset reference distances, front leading angles in the layout and auxiliary planes, and side trailing angles in the layout and auxiliary planes for gage cutting elements 461 are identified with respect to base reference plane 495, and offset reference planes, offset reference distances, front leading angles in the layout and auxiliary planes, and side trailing angles in the layout and auxiliary planes for bottom-hole cutting elements 462 are identified with respect to base reference plane 495'. Main gage cutting elements 461 and bottom-hole cutting elements 462 radially adjacent to gage cutting elements 461 are each preferably configured, positioned, and oriented in each rolling cone cutter (e.g., rolling cone cutters 301-303) to have (a) a cutting tip cross-sectional area ratio preferably less than or equal to 11%, and more preferably less or equal to 7%, at an offset reference plane disposed at an offset distance equal to 10% of the insert extension height; and a cutting tip cross-sectional area ratio preferably less than or equal to 19%, and more preferably less or equal to 11%, at an offset reference plane disposed at an offset distance equal to 15% of the insert extension height; (b) a cutting tip volumetric ratio preferably less than or equal to 0.8%, and more preferably less or equal to 0.5%, at an offset reference plane disposed at an offset distance equal to 10% of the insert extension height; and a cutting tip volumetric ratio preferably less than or equal to 1.8%, and more preferably less or equal to 1.1%, at an offset reference plane disposed at an offset distance equal to 15% of the insert extension height; (c) a front leading angle in the layout plane view or auxiliary plane view (e.g., front leading angle $\alpha_{Layout}$ or front leading angles $\alpha_{Aux}$) preferably greater than 20°, and more preferably greater than 25°; and a side trailing angle in the layout plane view or auxiliary plane view (e.g., side trailing angle $\beta_{Layout}$ or side trailing angle $\beta_{Aux}$) greater than 5°, and more preferably greater than 10°; or (d) combinations thereof.

Figure 23:
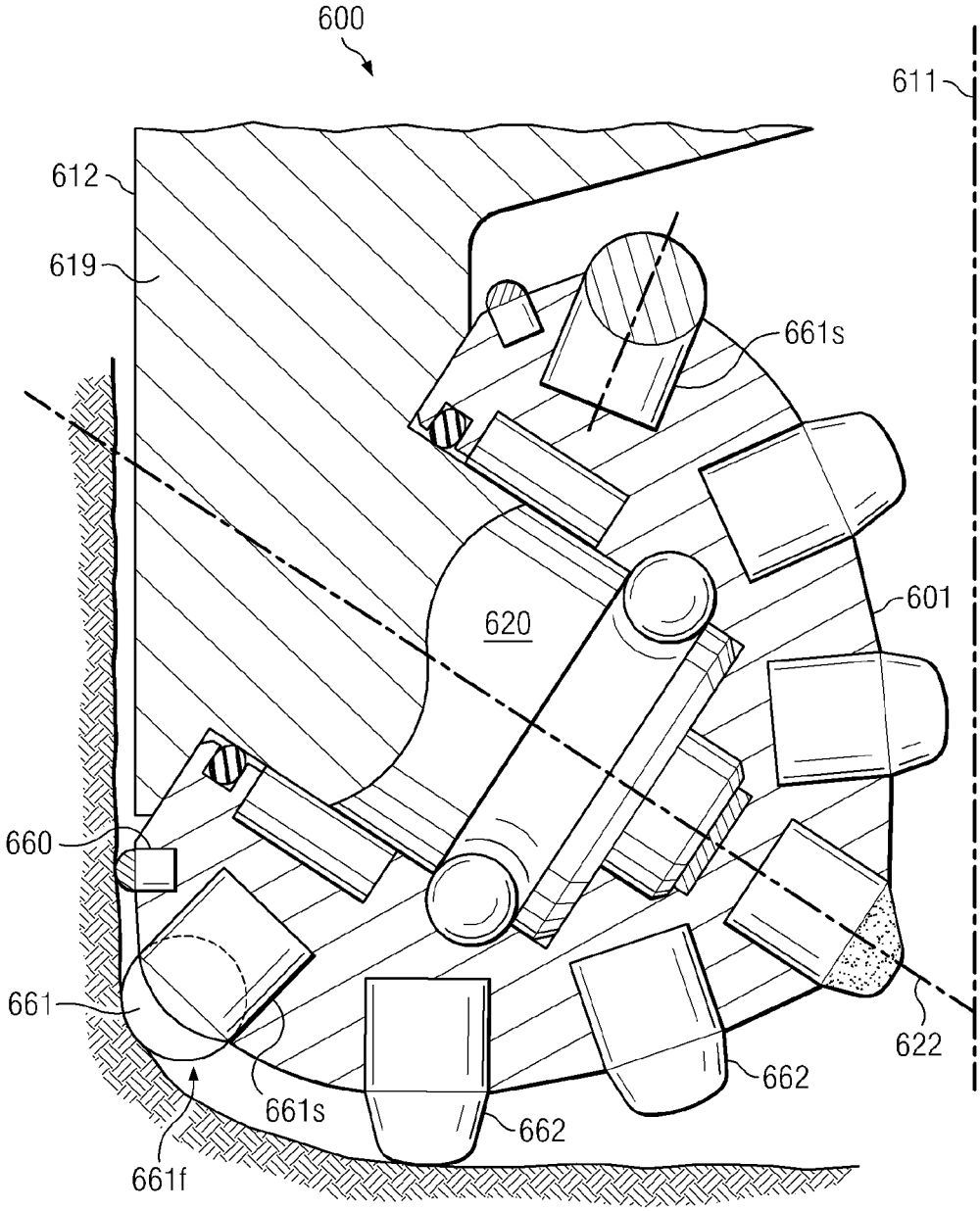
FIG. 23 is a partial section view taken through one leg and one rolling cone cutter of an embodiment of an earth-boring bit made in accordance with the principles described herein.

Referring now to FIG. 23, another embodiment of an earth-boring bit 600 constructed in accordance with the principles described herein is shown. Bit 600 is similar to bit 100 previously described. Namely, bit 600 includes a central bit axis 611 and a bit body 612 having a threaded section (not shown) at its upper end that is adapted for securing the bit 600 to a drill string (not shown). Bit 600 has a predetermined gage diameter, defined by the outermost reaches of three rolling cone cutters (only one cone cutter 601 is shown in FIG. 23) which are rotatably mounted on bearing shafts that depend from the bit body 612. Bit body 612 is composed of three sections or legs 619 (one leg is visible in FIG. 23) that are welded together to form bit body 612. Each cone cutter is mounted on a pin or journal 620 extending from bit body 612, and is adapted to rotate about a cone axis of rotation 622 oriented generally downwardly and inwardly toward the center of the bit. Each cone cutter includes a plurality of wear resistant inserts or cutting elements 660, 661, 662. Exemplary cone 601 includes heel cutting elements 660, gage cutting elements 661, and bottomhole cutting elements 662. However, unlike bit 100 previously described, in this embodiment, gage cutting elements 661 comprise PDC cutter elements that are pressed or brazed to their respective cone cutter in the gage row. As used herein, reference to "PDC cutter element" refers to a cutting element employing a hard cutting layer of polycrystalline diamond or other superabrasive material such as cubic boron nitride, thermally stable diamond, polycrystalline cubic boron nitride, or ultrahard tungsten carbide.

Each gage cutting element 661 comprises an elongated and generally cylindrical support member or substrate 661*s* which is received and secured in a mating pocket formed in the surface of the cone to which it is fixed. In general, each cutter element may have any suitable size and geometry. In addition, each gage cutting element 661 has a forward-facing cutting face 661*f* that comprises a generally disk shaped, hard cutting layer of polycrystalline diamond or other superabrasive material that is bonded to the exposed end of the support member 661*s*. As used herein, the phrase "forward-facing" refers to a cutting face that is perpendicular or at an acute angle relative to the cutting direction of the cutting face taking into account the rotation of the cone (to which the cutting face is mounted) about the cone axis and rotation of the bit about the bit axis.

Figure 24:
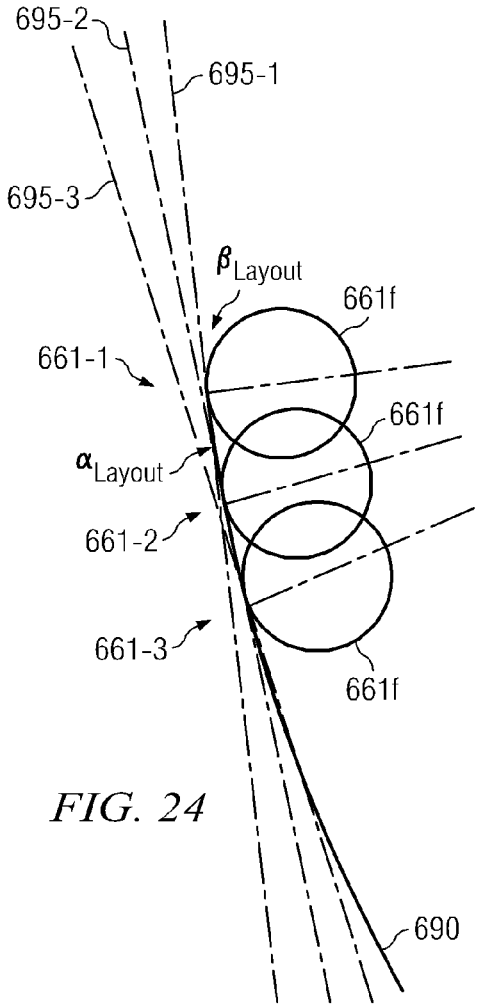
FIG. 24 is a layout plane view of select gage cutting elements of the bit shown in FIG. 23.

Referring now to FIG. 24, the cutting faces 661*f*, and hence cutting profiles, of each gage cutting element 661 on all three cones of bit 600 are shown in layout plane view. A portion of a gage curve 690 is shown. Gage cutting elements 661 on each cone are arranged in a circumferential row, however, unlike gage cutting elements 161 previously described, in this embodiment, gage-cutting elements 661 on different cones are disposed at different radial positions relative to bit axis 611 as viewed at their axially lowermost position relative to bit axis 611 (i.e., at the borehole bottom). Consequently, the cutting profiles of gage cutting elements 261 do not completely overlap in rotated profile view, but rather are "fanned" as best shown in the enlarged partial composite rotated profile view of FIG. 24. Gage cutting elements 661 on a first cone cutter are disposed in a circumferential row, but are disposed at a different radial position in composite rotated profile view as compared to gage cutting elements 661 on the other two cones. Further, gage cutting elements 661 on a second cone cutter are disposed in a circumferential row on the second cone cutter, but are disposed at a different radial position in composite rotated profile view as compared to gage cutting elements 661 on the other two cone cutters.

Figure 25:
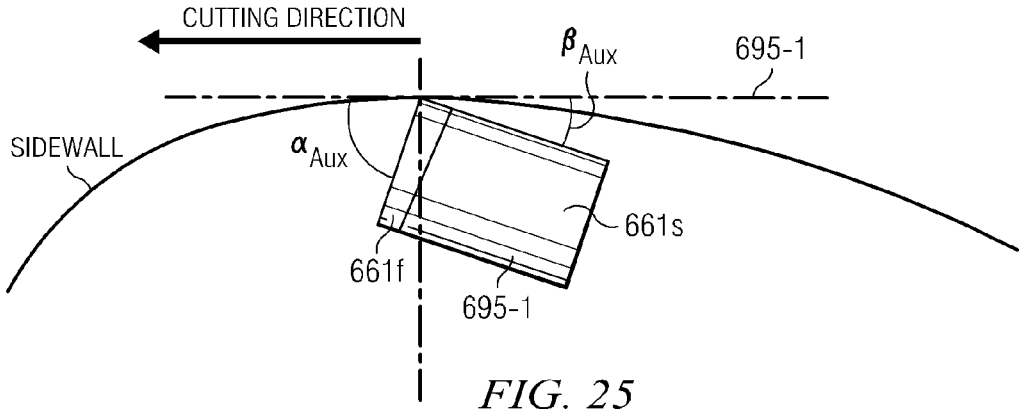
FIG. 25 is an auxiliary plane view of one of the gage cutting elements of the bit shown in FIG. 23.

Referring now to FIGS. 24 and 25, although gage cutting elements 661 on different cones are disposed at different radial positions, bit 600 has a single gage curve 690 determined according to conventional methods. Gage cutting elements 661 on the three different cones have a gage curve contact points 661-1, 661-2, 661-3. Further, a first base reference plane 695-1 is associated with gage cutting elements 661-1, a second base reference plane 695-2 is associated with gage cutting elements 661-2, and a third base reference plane 695-3 is associated with gage cutting elements 661-3. Offset reference planes, offset reference distances, front leading angles in the layout and auxiliary planes (i.e., $\alpha_{layout}$ and $\alpha_{aux}$), and side trailing angles in the layout and auxiliary planes (i.e., $\beta_{layout}$ and $\beta_{aux}$) for gage cutting elements 661-1, 661-2, 661-3 are identified with respect to base reference planes 695-1, 695-2, 695-3, respectively. In this embodiment, main gage cutting elements 661 are each configured, positioned, and oriented in each rolling cone cutter to have (a) a cutting tip cross-sectional area ratio preferably less than or equal to 11%, and more preferably less or equal to 7%, at an offset reference plane disposed at an offset distance equal to 10% of the insert extension height; and a cutting tip cross-sectional area ratio preferably less than or equal to 19%, and more preferably less or equal to 11%, at an offset reference plane disposed at an offset distance equal to 15% of the insert extension height; (b) a cutting tip volumetric ratio preferably less than or equal to 0.8%, and more preferably less or equal to 0.5%, at an offset reference plane disposed at an offset distance equal to 10% of the insert extension height; and a cutting tip volumetric ratio preferably less than or equal to 1.8%, and more preferably less or equal to 1.1%, at an offset reference plane disposed at an offset distance equal to 15% of the insert extension height; (c) a front leading angle in the layout plane view or auxiliary plane view (e.g., front leading angle $\alpha_{Layout}$ or front leading angles $\alpha_{Aux}$) preferably greater than 20°, and more preferably greater than 25°]; and a side trailing angle in the layout plane view or auxiliary plane view (e.g., side trailing angle $\beta_{Layout}$ or side trailing angle $\beta_{Aux}$) greater than 5°, and more preferably greater than 10°; or (d) combinations thereof.

Without being limited by this or any particular theory, utilizing PDC cutters with forward-facing cutting faces in the gage row of a rolling cone cutter offers the potential for enhanced shearing of the formation. Consequently, the use of PDC cutters as gage cutting elements offer the potential for improved cutting efficiency of the borehole corner, improved gage life and durability resulting from ultrahard materials (e.g., PDC table), more aggressive side cutting in directional applications (leading to more aggressive build rates or shorter slides), and improved bearing/seal reliability as a byproduct of increased gage durability. In addition, higher cone offset angles may be able to be utilized by having more efficient gage cutting.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A rolling cone drill bit for drilling a borehole in earthen formations, the bit comprising:

a bit body having a bit axis;

a plurality of rolling cone cutters mounted on the bit body, each of the plurality of cone cutters having a cone axis of rotation;

wherein each of the plurality of cone cutters includes a plurality of gage cutting elements and a plurality of bottomhole cutting elements arranged in a first inner row radially adjacent the plurality of gage cutting elements relative to the bit axis;

wherein each of the plurality of gage cutting elements has a base portion with a central axis, a cutting portion extending from the base portion to an extension height measured perpendicularly from a respective cone cutter of the plurality of gage cutting elements;

wherein each of the plurality of gage cutting elements contacts a gage curve defined by the drill bit at a gage curve contact point in a composite rotated profile view disposed in a layout plane, the layout plane containing the axis of one of the plurality of cone cutters and being parallel to the bit axis;

wherein a base reference plane is perpendicular to the layout plane and tangent to the gage curve at the gage curve contact point in the composite rotated profile view;

wherein each of the plurality of gage cutting elements has a cross-sectional area $A_1$ in a first offset reference plane parallel to the base reference plane and offset from the base reference plane by an offset distance $d_1$ measured perpendicularly from the base reference plane, the offset distance $d_1$ being equal to 10% of the extension height;

wherein the base portion of each of the plurality of gage cutting elements has a cross-sectional area $A_b$ in a plane perpendicular to the central axis of the base portion;

wherein the ratio of $A_1$ to $A_b$ is less than 11%.

2. The drill bit of claim 1, wherein the ratio of $A_1$ to $A_b$ is less or equal to 7%.

3. The drill bit of claim 1, wherein each of the plurality of gage cutting elements has a cross-sectional area $A_2$ in a second offset reference plane parallel to the base reference plane and offset from the base reference plane by an offset distance $d_2$ measured perpendicularly from the base reference plane, the offset distance $d_2$ being equal to 15% of the extension height;

wherein the ratio of $A_2$ to $A_b$ is less than 19%.

4. The drill bit of claim 3, wherein the ratio of $A_2$ to $A_b$ is less or equal to 11%.

5. The drill bit of claim 1, wherein the cutting portion of each of the plurality of gage cutting elements has a volume $V_{cp}$;

wherein the cutting portion of each of the plurality of gage cutting elements has a volume $V_1$ between the first offset reference plane and the base reference plane;

wherein the ratio of $V_1$ to $V_{cp}$ is less than or equal to 0.8%.

6. The drill bit of claim 5, wherein the ratio of $V_1$ to $V_{cp}$ is less than or equal to 0.5%.

7. The drill bit of claim 5, wherein the cutting portion of each of the plurality of gage cutting elements has a volume $V_2$ between the base reference plane and a second offset reference plane parallel to the base reference plane and offset from the base reference plane by an offset distance $d_2$ measured perpendicularly from the base reference plane, the offset distance $d_2$ being equal to 15% of the extension height;

wherein the ratio of $V_2$ to $V_{cp}$ is less than or equal to 1.8%.

8. The drill bit of claim 7, wherein the ratio of $V_2$ to $V_{cp}$ is less than or equal to 1.1%.

9. The drill bit of claim 1, wherein an auxiliary plane perpendicular to the base reference plane and perpendicular to the layout plane passes through the gage curve contact point in the composite rotated profile view;

wherein the cutting portion of a first of the plurality of gage cutting elements has a cutting surface including a leading adjacent surface extending from the gage curve contact point and a trailing adjacent surface extending from the gage curve contact point;

wherein a tangent to the leading adjacent surface is oriented at a front leading angle $\alpha_{Layout}$ relative to the base reference plane in the composite rotated profile view, and a tangent to the leading adjacent surface is oriented at a front leading angle $\alpha_{Aux}$ relative to the base reference plane in the auxiliary plane;

wherein the front leading angle $\alpha_{Layout}$ or the front leading angle $\alpha_{Aux}$ is greater than 20°.

10. The drill bit of claim 9 wherein the front leading angle $\alpha_{Layout}$ and the front leading angle $\alpha_{Aux}$ are each greater than 20°.

11. The drill bit of claim 9, wherein the front leading angle $\alpha_{Layout}$ or the front leading angle $\alpha_{Aux}$ is greater than 25°.

12. The drill bit of claim 9, wherein a tangent to the trailing adjacent surface is oriented at a side trailing angle $\beta_{Layout}$ relative to the base reference plane in the composite rotated profile view, and a tangent to the trailing adjacent surface is oriented at a side trailing angle $\beta_{Aux}$ relative to the base reference plane in the auxiliary plane;

wherein the side trailing angle $\beta_{Layout}$ or the side trailing angle $\beta_{Aux}$ is greater than 5°.

13. The drill bit of claim 12, wherein the side trailing angle R Layout and the side trailing angle $\beta_{Aux}$ are greater than 5°.

14. The drill bit of claim 13, wherein the side trailing angle $\beta_{Layout}$ or the side trailing angle $\beta_{Aux}$ is greater than 10°.

15. The drill bit of claim 9, wherein at least one of the plurality of gage cutting elements is a PDC cutter element;

wherein the base portion of the PDC cutter element comprises an elongate support member secured in one of the rolling cone cutters and the cutting portion of the PDC cutting element comprises a forward-facing cutting face oriented perpendicular or at an acute angle relative to a direction of impact with the formation;

wherein the cutting face of the PDC cutting element contacts the gage curve at the gage curve contact point in a composite rotated profile view;

wherein the cutting face of the PDC cutting element includes a leading adjacent surface extending from the gage curve contact point and a trailing adjacent surface extending from the gage curve contact point;

wherein a tangent to the leading adjacent surface of the cutting face of the PDC cutting element is oriented at a front leading angle $\alpha_{Layout}$ relative to the base reference plane in the composite rotated profile view, and a tangent to the leading adjacent surface of the cutting face of the PDC cutting element is oriented at a front leading angle $\alpha_{Aux}$ relative to the base reference plane in the auxiliary plane;

wherein the front leading angle $\alpha_{Layout}$ or the front leading angle $\alpha_{Aux}$ is greater than 25°.

16. The drill bit of claim 1, wherein each of the plurality of gage cutting elements is disposed at a radial position relative to the bit axis at the lowermost axial position relative to the bit axis in composite rotated profile view;

wherein the radial position of each of the plurality of gage cutting elements of the same rolling cone cutter is the same.

17. The drill bit of claim 16, wherein the radial position of each of the plurality of gage cutting elements on each of the plurality of rolling cone cutters is the same.

18. The drill bit of claim 16, wherein the radial position of the plurality of gage cutting elements of different rolling cone cutters is different.

19. The drill bit of claim 1, wherein each of the plurality of gage cutting elements is disposed at a radial position relative to the bit axis at the lowermost axial position relative to the bit axis in composite rotated profile view;

wherein the radial position of a first gage cutting element of a first of the rolling cone cutters is different from the radial position of a second gage cutting element of the first of the rolling cone cutters.

20. A rolling cone drill bit for drilling a borehole in earthen formations, the bit comprising:

a bit body having a bit axis;

a plurality of rolling cone cutters mounted on the bit body, each of the plurality of cone cutters having a cone axis of rotation;

wherein each of the plurality of cone cutters includes a plurality of gage cutting elements and a plurality of bottomhole cutting elements arranged in a first inner row radially adjacent the plurality of gage cutting elements relative to the bit axis;

wherein each of the plurality of gage cutting elements has a base portion with a central axis, a cutting portion extending from the base portion to an extension height measured perpendicularly from a respective cone cutter of the plurality of gage cutting elements;

wherein each of the plurality of gage cutting elements contacts a gage curve defined by the drill bit at a gage curve contact point in a composite rotated profile view disposed in a layout plane, the layout plane containing the axis of one of the plurality of cone cutters and being parallel to the bit axis;

wherein a base reference plane is perpendicular to the layout plane and tangent to the gage curve at the gage curve contact point in the composite rotated profile view;

wherein the cutting portion of each of the plurality of gage cutting elements has a volume $V_1$ between the base reference plane and a first offset reference plane parallel to the base reference plane and offset from the base reference plane by an offset distance $d_1$ measured perpendicularly from the base reference, the offset distance $d_1$ being equal to 10% of the extension height;

wherein the cutting portion of each of the plurality of gage cutting elements has a volume $V_{cp}$;

wherein the ratio of $V_1$ to $V_{cp}$ is less than or equal to 0.8%.

21. The drill bit of claim 20, wherein the ratio of $V_1$ to $V_{cp}$ is less than or equal to 0.5%.

22. The drill bit of claim 20, wherein the cutting portion of each of the plurality of gage cutting elements has a volume $V_2$ between the base reference plane and a second offset reference plane parallel to the base reference plane and offset from the base reference plane by an offset distance $d_2$ measured perpendicularly from the base reference, the offset distance $d_2$ being equal to 15% of the extension height;

wherein the ratio of $V_2$ to $V_{cp}$ is less than or equal to 1.8%.

23. The drill bit of claim 22, wherein the ratio of $V_2$ to $V_{cp}$ is less than or equal to 1.1%.

24. The drill bit of claim 20, wherein an auxiliary plane perpendicular to the base reference plane and perpendicular to the layout plane passes through the gage curve contact point in the composite rotated profile view;

wherein the cutting portion of a first of the plurality of gage cutting elements has a cutting surface including a leading adjacent surface extending from the gage curve contact point and a trailing adjacent surface extending from the gage curve contact point;

wherein a tangent to the leading adjacent surface is oriented at a front leading angle $\alpha_{Layout}$ relative to the base reference plane in the composite rotated profile view, and a tangent to the leading adjacent surface is oriented at a front leading angle $\alpha_{Aux}$ relative to the base reference plane in the auxiliary plane;

wherein the front leading angle $\alpha_{Layout}$ or the front leading angle $\alpha_{Aux}$ is greater than 20°.

25. The drill bit of claim 24, wherein a tangent to the trailing adjacent surface is oriented at a side trailing angle $\beta_{Layout}$ relative to the base reference plane in the composite rotated profile view, and a tangent to the trailing adjacent surface is oriented at a side trailing angle $\beta_{Aux}$ relative to the base reference plane in the auxiliary plane;

wherein the side trailing angle $\beta_{Layout}$ or the side trailing angle $\beta_{Aux}$ is greater than 5°.

26. The drill bit of claim 25, wherein the front leading angle $\alpha_{Layout}$ and the front leading angle $\alpha_{Aux}$ are each greater than 20°, and wherein the side trailing angle $\beta_{Layout}$ and the side trailing angle $\beta_{Aux}$ are each greater than 5°.

27. The drill bit of claim 20, wherein each of the plurality of gage cutting elements is disposed at a radial position relative to the bit axis at the lowermost axial position relative to the bit axis in the composite rotated profile view;

wherein the radial position of each of the plurality of gage cutting elements of the same rolling cone cutter is the same.

28. The drill bit of claim 27, wherein the radial position of each of the plurality of gage cutting elements on each of the plurality of rolling cone cutters is the same.

29. The drill bit of claim 27, wherein the radial position of the plurality of gage cutting elements of different rolling cone cutters is different.

30. The drill bit of claim 20, wherein each of the plurality of gage cutting elements is disposed at a radial position relative to the bit axis at the lowermost axial position relative to the bit axis in composite rotated profile view;

wherein the radial position of a first gage cutting element of a first of the rolling cone cutters is different from the radial position of a second gage cutting element of the first of the rolling cone cutters.

31. The drill bit of claim 30, wherein at least one of the plurality of gage cutting elements is a PDC cutter element;

wherein the base portion of the PDC cutter element comprises an elongate support member secured in one of the rolling cone cutters and the cutting portion of the PDC cutting element comprises a forward-facing cutting face oriented perpendicular or at an acute angle relative to a direction of impact with the formation;

wherein the cutting face of the PDC cutting element contacts the gage curve at the gage curve contact point in a composite rotated profile view;

wherein the cutting face of the PDC cutting element includes a leading adjacent surface extending from the gage curve contact point and a trailing adjacent surface extending from the gage curve contact point;

wherein a tangent to the leading adjacent surface of the cutting face of the PDC cutting element is oriented at a front leading angle $\alpha_{Layout}$ relative to the base reference plane in the composite rotated profile view, and a tangent to the leading adjacent surface of the cutting face of the PDC cutting element is oriented at a front leading angle $\alpha_{Aux}$ relative to the base reference plane in the auxiliary plane;

wherein the front leading angle $\alpha_{Layout}$ or the front leading angle $\alpha_{Aux}$ is greater than 25°.

32. A rolling cone drill bit for drilling a borehole in earthen formations, the bit comprising:

a bit body having a bit axis;

a plurality of rolling cone cutters mounted on the bit body, each of the plurality of cone cutters having a cone axis of rotation;

wherein each of the plurality of cone cutters includes a plurality of gage cutting elements and a plurality of bottomhole cutting elements arranged in a first inner row radially adjacent the plurality of gage cutting elements relative to the bit axis;

wherein each of the plurality of gage cutting elements has a base portion with a central axis, a cutting portion extending from the base portion to an extension height measured perpendicularly from a respective cone cutter of the plurality of gage cutting elements;

wherein each of the plurality of gage cutting elements contacts a gage curve defined by the drill bit at a gage curve contact point in a composite rotated profile view disposed in a layout plane, the layout plane containing the axis of one of the plurality of cone cutters and being parallel to the bit axis;

wherein a base reference plane is perpendicular to the layout plane and tangent to the gage curve at the gage curve contact point in the composite rotated profile view;

wherein an auxiliary plane perpendicular to the base reference plane and perpendicular to the layout plane passes through the gage curve contact point in the composite rotated profile view;

wherein the cutting portion of a first of the plurality of gage cutting elements has a cutting surface including a leading adjacent surface extending from the gage curve contact point and a trailing adjacent surface extending from the gage curve contact point;

wherein a tangent to the leading adjacent surface is oriented at a front leading angle $\alpha_{Layout}$ relative to the base reference plane in the composite rotated profile view, and a tangent to the leading adjacent surface is oriented at a front leading angle $\alpha_{Aux}$ relative to the base reference plane in the auxiliary plane;

wherein the front leading angle $\alpha_{Layout}$ or the front leading angle $\alpha_{Aux}$ is greater than 20°.

33. The drill bit of claim 32 wherein the front leading angle $\alpha_{Layout}$ and the front leading angle $\alpha_{Aux}$ are each greater than 20°.

34. The drill bit of claim 32, wherein the front leading angle $\alpha_{Layout}$ or the front leading angle $\alpha_{Aux}$ is greater than 25°.

35. The drill bit of claim 32, wherein a tangent to the trailing adjacent surface is oriented at a side trailing angle $\beta_{Layout}$ relative to the base reference plane in the composite rotated profile view, and a tangent to the trailing adjacent surface is oriented at a side trailing angle $\beta_{Aux}$ relative to the base reference plane in the auxiliary plane;

wherein the side trailing angle $\beta_{Layout}$ or the side trailing angle $\beta_{Aux}$ is greater than 5°.

36. The drill bit of claim 35, wherein the side trailing angle $\beta_{Layout}$ and the side trailing angle $\beta_{Aux}$ are greater than 5°.

37. The drill bit of claim 35, wherein the side trailing angle $\beta_{Layout}$ or the side trailing angle $\beta_{Aux}$ is greater than 10°.

38. The drill bit of claim 32, wherein at least one of the plurality of gage cutting elements is a PDC cutter element;

wherein the base portion of the PDC cutter element comprises an elongate support member secured in one of the rolling cone cutters and the cutting portion of the PDC cutting element comprises a forward-facing cutting face oriented perpendicular or at an acute angle relative to a direction of impact with the formation;

wherein the cutting face of the PDC cutting element contacts the gage curve at the gage curve contact point in a composite rotated profile view;

wherein the cutting face of the PDC cutting element includes a leading adjacent surface extending from the gage curve contact point and a trailing adjacent surface extending from the gage curve contact point;

wherein a tangent to the leading adjacent surface of the cutting face of the PDC cutting element is oriented at a front leading angle $\alpha_{Layout}$ relative to the base reference plane in the composite rotated profile view, and a tangent to the leading adjacent surface of the cutting face of the PDC cutting element is oriented at a front leading angle $\alpha_{Aux}$ relative to the base reference plane in the auxiliary plane;

wherein the front leading angle $\alpha_{Layout}$ or the front leading angle $\alpha_{Aux}$ is greater than 25°.

* * * * *